US005979199A

United States Patent [19]

Elpern et al.

[11] Patent Number: 5,979,199

[45] **Date of Patent: *Nov. 9, 1999**

[54] ELECTRICALLY OPERATED ACTUATOR

[75] Inventors: Stephen R. Elpern, Chicago, Ill.; David G. Elpern, Los Angeles, Calif.; Allen C. Ward; Walid Habib, both of Ann Arbor, Mich.; Paul Evans, Chicago, Ill.; Scott Padiak, Winnetka, Ill.; David Corbett Brown, Chicago, Ill.; Robb Allan Peebles, Cottage Grove, Wis.

[73] Assignee: Access Technologies, Inc., Chicago, Ill.

[ * ] Notice: This patent is subject to a terminal disclaimer.

[21] Appl. No.: 08/950,875

[22] Filed: Oct. 15, 1997

Related U.S. Application Data

[63] Continuation-in-part of application No. 08/713,895, Sep. 13, 1996, Pat. No. 5,896,769.

[51] Int. Cl.[6] ..... E05B 47/00

[52] U.S. Cl. ..... 70/279; 292/201; 340/825.31; 361/172

[58] Field of Search ..... 340/825.31; 361/172; 70/275, 277–283; 292/201, 144, 336.3

[56] References Cited

U.S. PATENT DOCUMENTS

| | | | |
|---|---|---|---|
| 2,665,577 | 1/1954 | Sanowskis | 70/133 |
| 2,750,786 | 6/1956 | Sanowskis | 70/313 |
| 3,733,861 | 5/1973 | Lester | 70/153 |
| 4,135,377 | 1/1979 | Kleefeldt et al. | 70/279 X |
| 4,148,092 | 4/1979 | Martin | 361/172 X |
| 4,317,147 | 2/1982 | Daughenbaugh et al. | 360/113 |
| 4,317,157 | 2/1982 | Eckloff | 361/172 |
| 4,596,985 | 6/1986 | Bongard et al. | 340/825.31 |
| 4,631,527 | 12/1986 | De Witt et al. | 340/539 |
| 4,665,727 | 5/1987 | Uyeda | 70/279 |
| 4,677,834 | 7/1987 | Hicks | 70/279 |
| 4,691,542 | 9/1987 | Young | 70/279 X |
| 4,743,898 | 5/1988 | Imedio | 340/825.31 |
| 4,786,900 | 11/1988 | Karasawa et al. | 340/825.31 |

(List continued on next page.)

OTHER PUBLICATIONS

Weiser Lock Powerbolt Electronic Keyless Entry System Packaging, © 1996.

Weiser Lock Powerbolt, *Installation & Programming Instructions Owner's Manual*, No Date.

Photographs of the Weiser Lock Powerbolt.

*Primary Examiner*—Suzanne Dino Barrett

*Attorney, Agent, or Firm*—Reginald J. Hill; The Hill Law Firm, Ltd.

[57] ABSTRACT

An electrically operated actuator (12, 112, 212, 312, 800) automatically operates dead-bolt assemblies and other locks, while preserving manual operation of the locks. The actuator assembly has rotating means for rotation of the drive bar (18), which in turn extends or retracts the bolt (14) of the lock. The rotating means may be a lever (28, 128, 238, 328, 438, 818) attached to the drive bar (18) that is pivotable about the axis of rotation of the drive bar (18). The actuator assembly has driving means that forces the rotating means to rotate. The driving means is responsive to an electrical signal, which, for example, may be initiated from a remote-controlled transmitter (502, 602). The driving means may include a motor (20, 120, 220) for rotating a rod (22, 122, 222, 322) that in turn operates an assembly that rotates or drives the rotating means. In response to an electrical signal, the driving means actuates the rotating means to affect either a locking or unlocking operation, which operations are always completed by placing the actuator assembly in a state whereby the bolt of the lock may subsequently be extended or retracted manually, or automatically by the driving means.

19 Claims, 23 Drawing Sheets

U.S. PATENT DOCUMENTS

| | | | |
|---|---|---|---|
| 4,802,353 | 2/1989 | Corder et al. | 70/277 |
| 4,808,995 | 2/1989 | Clark et al. | 340/825.31 X |
| 4,849,749 | 7/1989 | Fukamachi et al. | 340/825.31 |
| 4,854,143 | 8/1989 | Corder et al. | 70/218 |
| 4,864,494 | 9/1989 | Kobus, Jr. | 364/200 |
| 4,893,704 | 1/1990 | Fry et al. | 192/141 |
| 4,931,789 | 6/1990 | Pinnow | 340/825.31 |
| 5,103,221 | 4/1992 | Memmola | 340/825.31 |
| 5,107,258 | 4/1992 | Soum | 340/825.31 |
| 5,148,691 | 9/1992 | Wallden | 70/279 |
| 5,199,288 | 4/1993 | Merilainen et al. | 70/279 |
| 5,204,672 | 4/1993 | Brooks | 340/825.31 X |
| 5,280,881 | 1/1994 | Karmin | 70/279 |
| 5,328,218 | 7/1994 | Brusasco et al. | 292/201 |
| 5,379,033 | 1/1995 | Fujii et al. | 340/825.31 X |
| 5,406,274 | 4/1995 | Lambropoulos et al. | 340/825.31 X |
| 5,441,315 | 8/1995 | Kleefeldt et al. | 70/276 X |
| 5,442,341 | 8/1995 | Lambropoulos | 340/825.31 |
| 5,475,377 | 12/1995 | Lee | 340/825.34 |
| 5,486,812 | 1/1996 | Todd | 340/539 |
| 5,487,289 | 1/1996 | Otto, III et al. | 70/279 |
| 5,504,478 | 4/1996 | Knapp | 340/875.69 |
| 5,508,687 | 4/1996 | Gebhardt etal. | 340/825.31 |
| 5,526,710 | 6/1996 | Ohta | 70/277 X |
| 5,628,535 | 5/1997 | Buscher et al. . | |
| 5,634,676 | 6/1997 | Feder | 70/279 X |

ELECTRICALLY OPERATED ACTUATOR

This is a continuation-in-part of patent application Ser. No. 08/713,895 filed Sep. 13, 1996, now U.S. Pat. No. 5,896,769.

FIELD OF THE INVENTION

The present invention generally relates to an actuator assembly, and more specifically, to an electrically operated actuator for use with dead-bolt assemblies and other door locks.

BACKGROUND OF THE INVENTION

A convenient and reliable locking assembly for doors is a critical and important part of any security system. In commercial settings, property must be secured to prevent theft and vandalism. In residential settings, a convenient and reliable locking assembly may even be more important where the safety of the inhabitants is also at stake.

Traditionally, mechanically operated locking assemblies are used in which the operator inserts a key into the locking device and then rotates the key to retract or extend a bolting mechanism. While this mechanical solution is reliable, there are many inconveniences associated with using a mechanical key system. For example, for a person in a dark area, it is difficult to find the key, orient the key, and insert it into the lock. Also, for a person occupied with carrying items, it is difficult to manage the items and also manipulate a key. These are only a few of the many limitations and inconveniences associated with a mechanically operated locking system.

Electrically operated locking assemblies have been proposed to address the limitations of purely mechanical locks. For example, U.S. Pat. Nos. 3,733,861, 4,148,092 and 5,487,289, issued to Lester, Martin and Otto, III, et al., respectively, disclose electrically activated locks. However, these locks provide an electrically operated passive means for restraining manual operation of the bolt mechanism. These systems do not have an active means for extending and retracting the bolt mechanism directly. Further, some of these systems do not allow concurrent manual and electric operation.

Recently the automobile industry has adopted remote controlled devices to actuate automobile door locks. The convenience of these remote control capabilities is tremendous in comparison with mechanically operated locks and has been well accepted by consumers. However, the use of remote controlled locking systems for doors outside of the automobile industry has been limited due to no reliable and economical actuating assembly which can be used with doors and dead-bolt assemblies such as those found in residences. In particular, there is no actuating assembly which can be adapted to utilize conventional dead-bolt assemblies and also retain the ability to use the conventional key method of operating a dead-bolt assembly. Further, there is no actuating assembly that can be retrofit to an existing dead-bolt assembly.

Therefore, a need exists for an electrically operated actuator assembly for automation of the locking and unlocking of dead-bolt assemblies, and in particular, a need exists for an electrically operated actuator assembly that can preserve the conventional key method of operation and also be retrofit to an existing dead-bolt assembly.

SUMMARY OF THE INVENTION

Accordingly, an object of the present invention is to provide a convenient and reliable electrically operated actuating assembly.

A further object of the present invention is to provide an electrically operated actuator assembly which is adapted to respond to a remote transmitter/receiver device.

Another object of the present invention is to provide an electrically operated actuator assembly which can readily be adapted to dead-bolt assemblies for doors so that both a conventional key and a remote transmitter can be utilized to operate the dead-bolt assembly.

Another object of the present invention is to provide an electrically operated actuator assembly which can be easily added to, or retrofit for, a conventional dead-bolt assembly already installed on a door.

In accordance with the present invention, all of these objects, as well as others not herein specifically identified, are achieved generally by an electrically operated, remote-controlled actuator assembly which can be used with a locking system while preserving the option of using a key in a standard mode. More specifically, as discussed below, the present invention includes a driving means and a rotating means which operate on a conventional lock or dead-bolt assembly.

A conventional dead-bolt assembly includes a bolt, a drive bar, a cylinder which receives a conventional key on the exterior side of the door, and either a knob or another cylinder on the interior side of the door. The bolt is coupled to the drive bar such that rotation of the drive bar extends or retracts the bolt, depending on the direction of rotation. The exterior cylinder and the interior cylinder, if there is one, are coupled to the drive bar such that a key may be inserted into either cylinder and turned to rotate the drive bar, extending or retracting the bolt. Similarly, if there is a knob, rather than a cylinder, attached to the drive bar, the bolt can be extended or retracted by rotation of the knob.

In accordance with the present invention, a rotating means is coupled to the drive bar such that the rotating means is capable of rotating the drive bar and thus the bolt. The driving means, in response to an electrical signal, actuates the rotating means to effect the extension or retraction of the bolt, causing a locking or unlocking operation. After actuation by the driving means, the rotating means is placed in a state whereby the bolt may be extended or retracted manually, that is, by use of a key or knob, or automatically by the driving means.

In one embodiment, the rotating means includes a resilient lever that is attached to the drive bar to rotate the drive bar, causing the bolt to extend and retract. The resilient lever has an axis of rotation that is coaxial with the axis of rotation of the drive bar. The driving means includes a motor capable of bidirectional rotation of a threaded rod extending therefrom. A threaded member is screwed onto the threaded rod, but means are provided to prevent rotation of the threaded member about the threaded rod, thereby allowing the threaded member to extend along the length of the threaded rod, depending on the direction of rotation of the motor. The threaded member has a protrusion positioned to engage the lever and pivot the lever from a first position wherein the bolt is extended, to a second position wherein the bolt is retracted. The lever is resilient so that the protrusion on the threaded member may force the lever out of its path when the lever has reached the end of its range of rotation, for example, when the lever has attained the first position or the second position. This allows the protrusion to be placed in a position such that the lever is free for rotating manually, as is required for key or knob operation, and also places the protrusion in position for reciprocal movement of the lever.

In another embodiment, the rotating means includes a rigid, non-resilient lever that is attached to the drive bar to rotate the drive bar, causing the bolt to extend and retract. The rigid lever has an axis of rotation that is coaxial with the axis of rotation of the drive bar and is pivotable from a first position wherein the bolt is extended, to a second position wherein the bolt is retracted. The driving means includes a bidirectional motor capable of rotating a threaded rod extending therefrom. An actuating arm with a first protrusion at one end of the arm and a second protrusion at the opposite end of the arm is threaded onto the threaded rod such that rotation of the motor causes the arm to extend along the length of the threaded rod. The actuating arm is placed with respect to the lever such that the levers range of motion, that is, from the first position to the second position, is always between the first and second protrusions of the actuating arms. Thus, one protrusion can be extended by the motor to pivot the lever from the first position to the second position, while the second protrusion can be extended by the motor to pivot the lever from the second position to the first position. Whenever the motor is cycled to force the lever to a particular position, after the desired position is obtained, the motor automatically cycles in the opposite direction to place the protrusions in position for manual operation of the lock and for subsequent electrical operation. For fail-safe operation, the first and second protrusions on the actuating arm may be cantilevered such that the lever may be manually forced over either protrusion if, for example, the motor fails leaving either protrusion in a position adverse to manual operation.

Several other alternatives for driving means, including solenoids are disclosed. Additionally, alternative rotating means including circular gears and various lever arrangements are disclosed. Preferably, the rotating means includes an adaptor that is easily positioned over a drive bar of an existing lock, the adaptor including either the resilient or non-resilient lever and an extended drive bar for receiving a knob or interior cylinder.

Electrical activation is accomplished in the invention by use of a remote control unit. The remote control unit includes at least a transmitter, a receiver and a control circuit. Preferably, the transmitter is also a receiver or a transmitter/receiver and the receiver is also a transmitter or a receiver/transmitter. The transmitter/receiver sends a signal to lock or unlock. The signal is received by the receiver/transmitter and sent to the control circuit. The control circuit activates the driving means in accordance with the signal received by the receiver/transmitter and monitors the status of the lock. The status monitored by the control circuit, as determined by appropriate sensors, includes successful or unsuccessful completion of rotation of the rotating means to the locked or unlocked position, or sensing the position of the driving means, or sensing the position of the rotating means and the driving means. The status determined by the control circuit is sent by the receiver/transmitter to the transmitter/receiver, which may give a visual and/or audible indication to the user.

The circuits used for electrical activation are preferably battery powered and thus require low power operation and judicious power management. This is accomplished in part by switching power to components only as needed. Also, components have multiple functions that may be time multiplexed for efficient use and low power operation. Further, the voltage of the batteries may be sensed and the current for the driving means may be sensed to ensure proper operation and detect problems and failures.

The invention includes a method for retrofitting an existing lock or dead-bolt assembly with an electrically operated actuator. The existing lock has an interior cylinder or knob, an exterior cylinder, a drive bar and existing mounting hardware, such as bolts. In accordance with one method, first the interior cylinder or knob is removed. Then, a support plate having an opening formed therein and a preassembled actuator in accordance with the present invention mounted thereon is mounted on the door such that the opening formed in the plate receives the existing mounting hardware from the exterior cylinder. A mounting plate is then aligned over the support plate such that bores in the mounting plate receive the existing mounting hardware from the exterior cylinder. A lever having an axis of rotation that is coaxial with an axis of rotation of the drive bar is coupled to the drive bar prior to securely reattaching the interior cylinder or knob and any desired protective cover.

In accordance with another method for retrofitting an existing lock or dead-bolt assembly with an electrically operated actuator, the interior cylinder or knob is removed. Then an adaptor is placed on to the existing drive bar. One end of the adaptor is adapted to receive the drive bar and the other end of the adaptor is adapted to be received by a lever assembly housed within a preassembled actuator that includes in addition to the lever assembly, a knob or cylinder, a cover, and a base plate with an actuator mounted thereon. The preassembled actuator is aligned over the adaptor with the lever assembly positioned to receive the adaptor. Mounting hardware is used to secure the preassembled actuator on to the existing lock.

BRIEF DESCRIPTION OF THE DRAWINGS

Further objects of the invention, taken together with additional features thereto and advantages occurring therefrom, will be apparent from the following description of the invention when read in conjunction with the accompanying drawings, wherein.

DETAILED DESCRIPTION OF THE PREFERRED EMBODIMENTS

Figure 1:
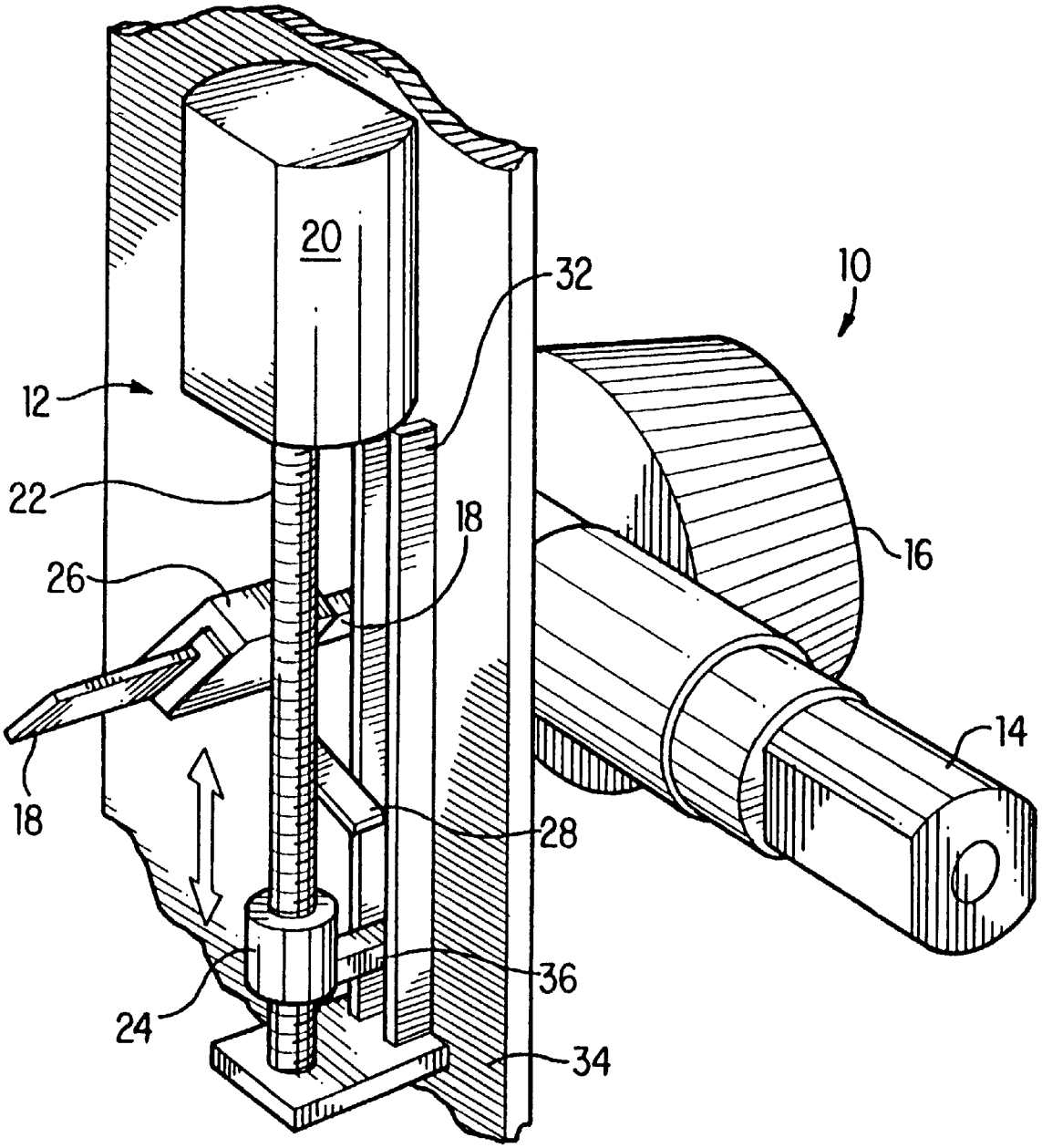
FIG. 1 is a perspective view of a dead-bolt assembly coupled with an electrically operated actuator embodiment in accordance with the present invention, wherein the dead-bolt assembly is in the locked position.

FIG. 1 shows a dead-bolt assembly, generally designated as 10, which can be driven by an electrically operated actuator, generally designated as 12, in accordance with the present invention. The dead-bolt assembly 10 consists of a bolt 14, an exterior drive cylinder 16 and a drive bar 18. An interior drive cylinder (not shown), or knob (not shown), may be attached to the end of drive bar 18 opposite exterior drive cylinder 16. Drive bar 18 is coupled to bolt 14 in a conventional manner such that rotation of drive bar 18 extends or retracts bolt 14. Cylinder 16 is coupled to drive bar 18 in a conventional manner such that rotation of a proper key in cylinder 16 rotates drive bar 18. Thus, drive cylinder 16 extends or retracts bolt 14 depending on the rotational direction of the key.

Drive cylinder 16 and bolt 14 are separated from electrically operated actuator 12 by a plate 34 having an opening (not shown) for the drive bar 18 to extend through. Plate 34 may be mounted to the door (not shown). Plate 34 is not necessary, but provides a convenient base to which electrically operated actuator 12 may be mounted. Any similar substitute structure would suffice.

The embodiment of the electrically operated actuator assembly 12 depicted in FIG. 1, consists of driving means, including a motor 20 and a threaded rod 22; and rotating means, including a nut 24, an adaptor 26, a lever 28 and a guide 32. It is preferable to secure motor 20 to plate 34. Threaded rod 22 is connected at one end to electric motor 20, which is capable of bi-directional rotation and also has overload protection. Nut 24 has a hole that is threaded for receiving threaded rod 22, and a tongue 36 that extends radially outward from nut 24. Adaptor 26 is secured on drive bar 18 and is utilized to secure resilient lever 28 to extend radially away from drive bar 18. Resilient lever 28 is either spring-loaded, as is known in the art, or is sufficiently resilient so that it can be pushed to one side or the other and will always return to its original position. Guide 32, preferably secured onto mounting plate 34, defines a channel adapted to receive tongue 36 and to allow sliding movement of tongue 36 along the length of the channel. Guide 32 is aligned in parallel orientation with threaded rod 22 so that tongue 36 will remain in the channel throughout movement of the nut 24 along the length of threaded rod 22.

When motor 20 is activated, threaded rod 22 is rotated. Depending on the direction of rotation and threading, nut 24 will be raised or lowered along the length of rod 22 from a first or locked position to a second or unlocked position. Tongue 36 is retained in guide 32 to prevent nut 24 from rotating.

Figure 1A:
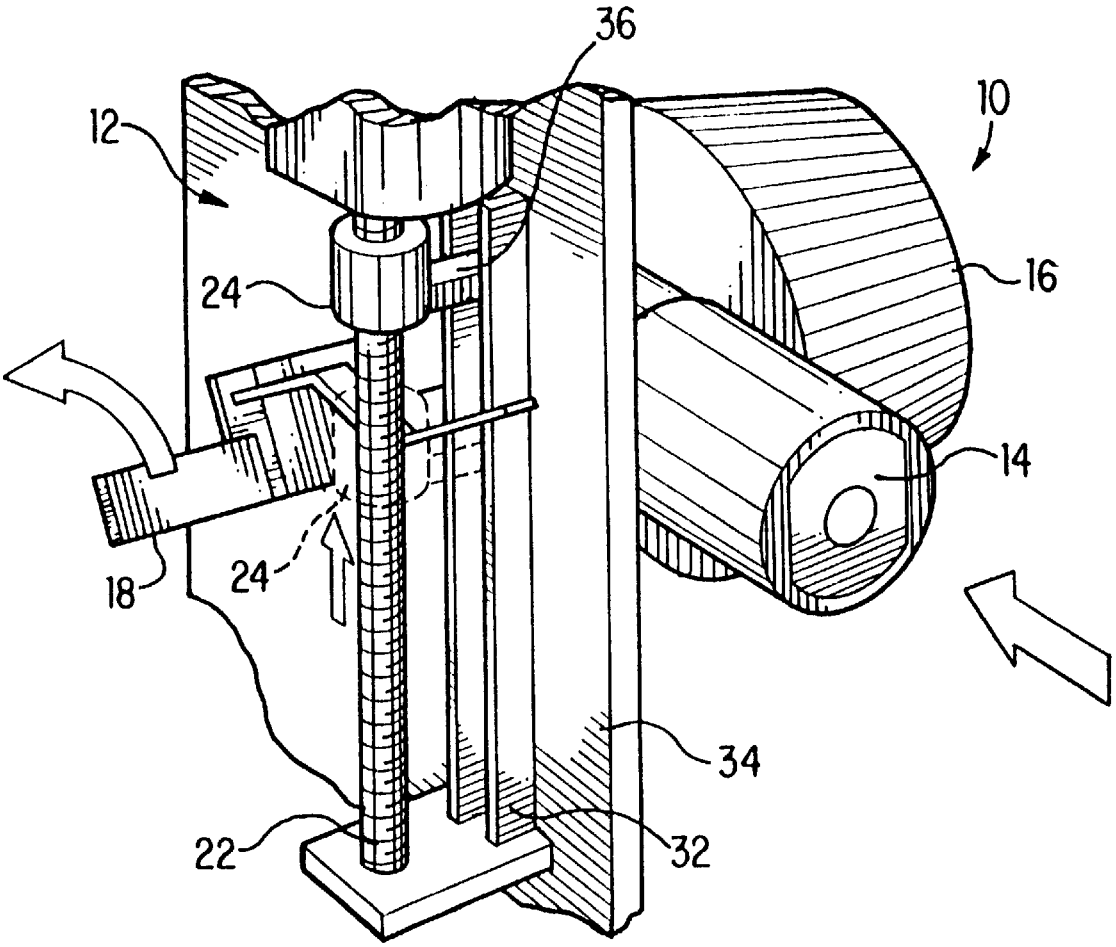
FIG. 1A is a perspective view of the dead-bolt assembly and actuator shown in FIG. 1, wherein the dead-bolt assembly is in the unlocked position.

From the locked position shown in FIG. 1, motor 20 can be activated to unlock dead-bolt assembly 12 by raising nut 24. As nut 24 is raised, tongue 36 will exert an upward force on lever 28, moving lever 28 towards the upper or unlocked position, causing drive bar 18 to rotate counterclockwise. The rotation of drive bar 18 will cause bolt 14 to retract, thus unlocking the door. Drive bar 18 does not rotate further counterclockwise once bolt 14 is fully retracted. (See nut 24 in phantom in FIG. 1A). However, motor 20 continues to drive nut 24 upward, pushing it through the flexing resilient lever 28, until tongue 36 is driven beyond lever 28. Lever 28 then rebounds to its original position. As shown in FIG. 1A, tongue 36 is then ready to drive lever 28 in an opposite direction, i.e., back to the locked position. Additionally, tongue 36 is positioned not to interfere with lever 28 if a user rotates drive bar 18 by using a key or knob.

From the unlocked position shown in FIG. 1A, motor 20 can be activated to lock dead-bolt assembly 12 by lowering nut 24 until it pushes lever 28 downward, thus causing the drive bar 18 to rotate in a clockwise direction. The rotation of drive bar 18 extends bolt 14. Once bolt 14 is fully extended, drive bar 18 does not rotate further in the clockwise direction. However, nut 24 continues in its downward path until tongue 36 pushes through resilient lever 28. After tongue 36 is driven beyond lever 28, as shown in FIG. 1, motor 20 stops operation. Resilient lever 28 then rebounds to its original position such that tongue 36 is in a position to catch lever 28 when tongue 36 is driven in the opposite direction. Notably, when motor 20 stops operation, tongue 36 is positioned not to interfere with manual operation of dead-bolt assembly 10, that is, operation with a key or knob.

Figure 2:
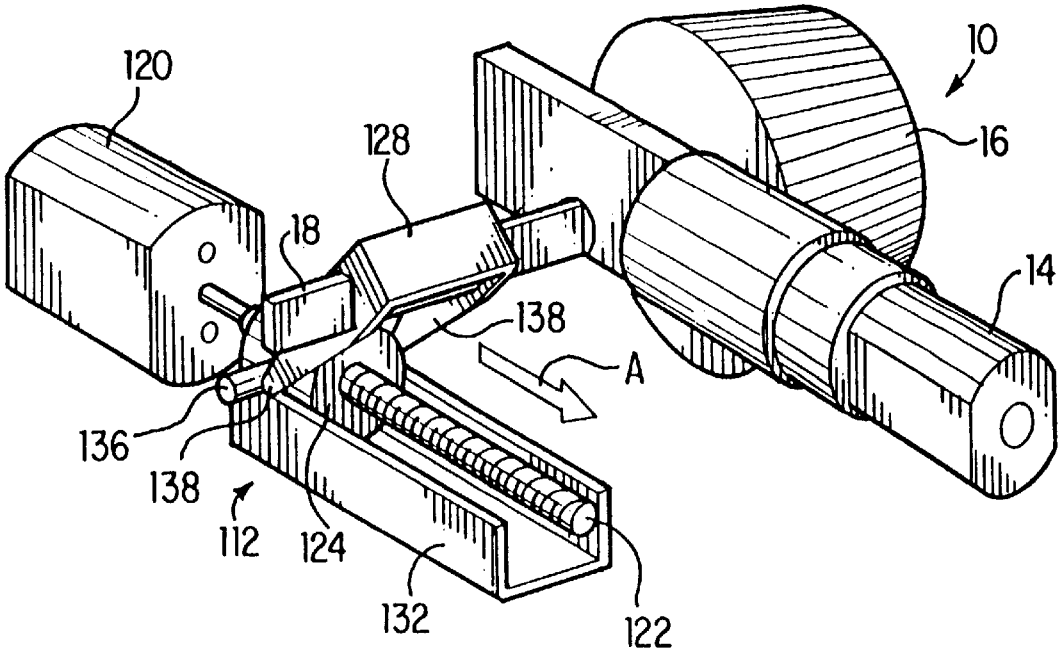
FIG. 2 is a perspective view of a dead-bolt assembly coupled with another electrically operated actuator embodiment in accordance with the present invention, wherein the dead-bolt assembly is in the locked position.

Turning now to FIG. 2, dead-bolt assembly 10 is shown driven by an electrically operated actuator 112 in accordance with another embodiment of the present invention. A motor 120 is horizontally oriented such that a threaded rod 122 attached to motor 120 and a guide 132 are parallel to bolt 14. In this embodiment, guide 132 receives a portion of a generally cylindrical nut 124, which is capable of sliding movement along the length of the channel defined by guide 132. Nut 124 is provided with two prongs 136 (see FIG. 2A) which extend radially out from nut 124 and rest along guide 132. Prongs 136 prevent rotation of nut 124 when threaded rod 122 is rotated by motor 120. A U-shaped lever 128 having a pair of resilient arms 138 is secured directly onto drive bar 18.

Figure 2A:
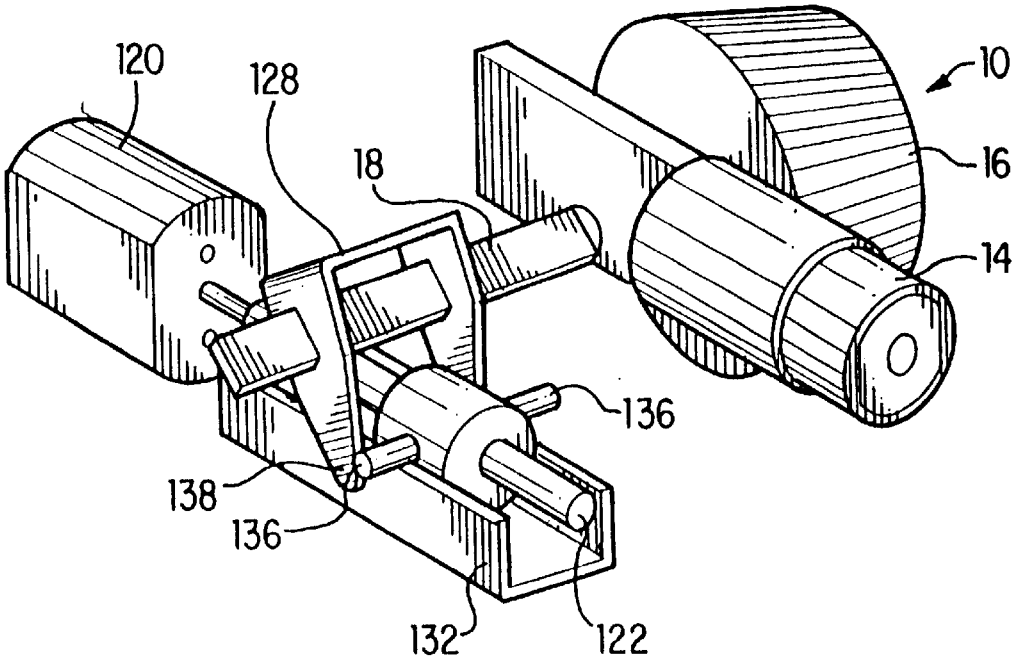
FIG. 2A is a perspective view of the dead-bolt assembly and actuator shown in FIG. 2, wherein the dead-bolt assembly is in the unlocked position.

Motor 120 is activated to rotate threaded rod 122, which in turn causes linear movement of nut 124 along guide 132 to affect a locking or unlocking operation. For example, dead-bolt assembly 110 is shown in a locked position in FIG. 2control unlocking operation under control of electrically operated actuator 112 is desired, motor 120 is activated to cause nut 124 to move in the direction of arrow A. Prongs 136 of nut 124 contact resilient arms 138 of lever 128. The progression of nut 124 along guide 132 causes prongs 136 to force resilient arms 138 to rotate lever 128, causing a corresponding rotation of drive bar 18, which results in the retraction of bolt 14. Drive bar 18 reaches the end of its rotational travel when bolt 14 is completely retracted. This prevents further rotation of lever 128. However, motor 120 continues to extend nut 124 along guide 132, forcing prongs 136 to bend resilient arms 138, eventually forcing prongs 136 and nut 124 to extend beyond resilient arms 138, as shown in FIG. 2A. When motor 120 stops, prongs 136 are positioned beyond resilient arms 138 to facilitate manual operation of the lock and also to facilitate a locking operation by reversing the direction of motor 120.

Figure 3:
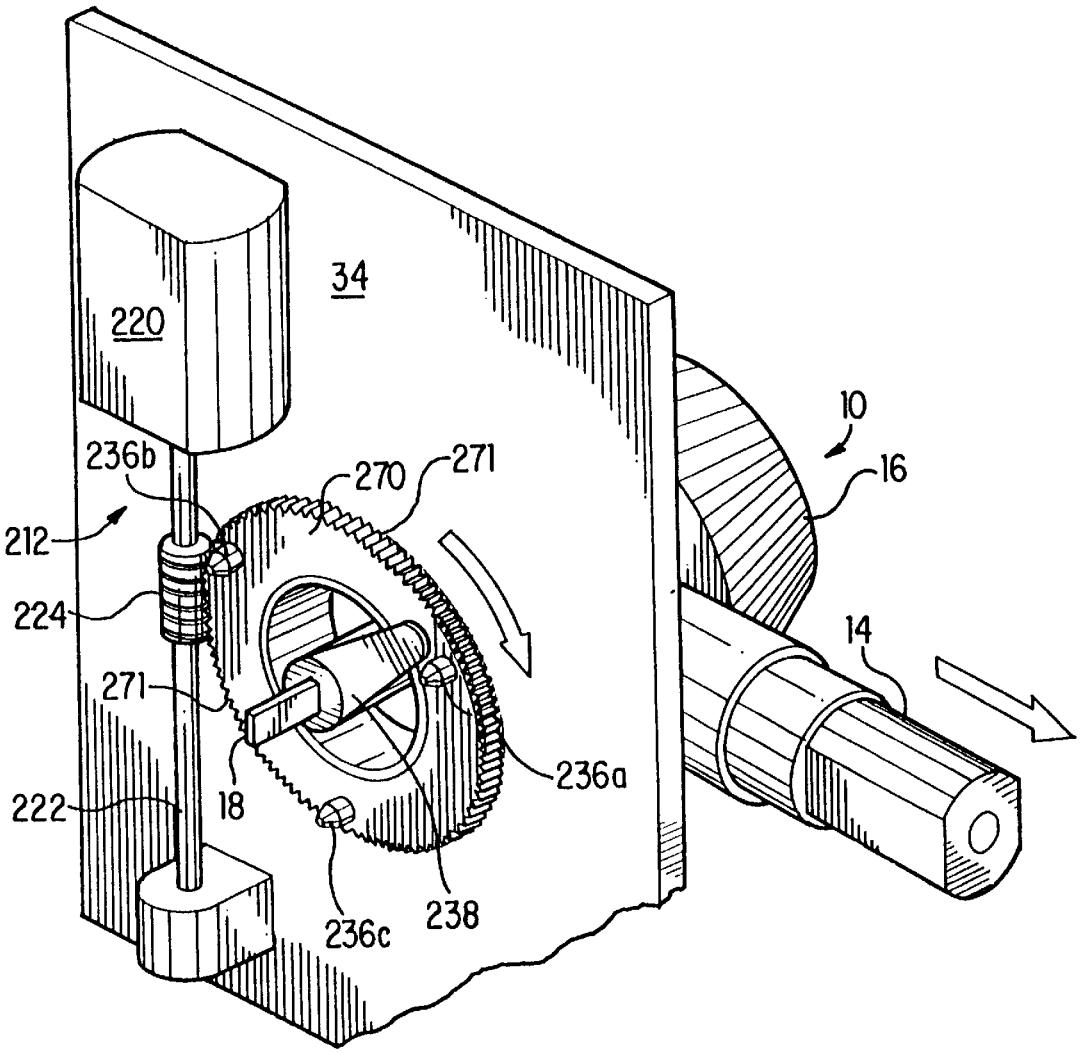
FIG. 3 is a perspective view of a dead-bolt assembly coupled with a third embodiment of an actuator in accordance with the present invention, wherein the dead-bolt assembly is in the locked position.

FIG. 3 shows another embodiment of an electrically operated actuator assembly 212 coupled to dead-bolt assembly 10. Electrically operated actuator assembly 212 has a motor 220 that rotates a rod 222. Attached to rod 222 is a first threaded gear 224. A lever 238 is attached to drive bar 18 such that rotation of lever 238 causes rotation of drive bar 18. Between lever 238 and plate 34 is a circular gear 270 having teeth 271 along its perimeter. Gear 270 is mounted in a known manner for rotation about an axis coaxial to drive bar 18. Circular gear 270 has three protrusions 236*a–c* which are spaced an equal distance apart from each other near the perimeter of circular gear 270. Protrusions 236*a–c* are sized to contact lever 238 for rotating lever 238. Circular gear 270 and threaded gear 224 are positioned in cooperation such that rotation of threaded gear 224 causes corresponding rotation in circular gear 270. Lever 238 is resilient in a direction parallel to the axis of rotation of drive bar 18.

To effect a locking or unlocking operation with electrically operated actuator assembly 212, motor 220 drives threaded gear 224, which in turn rotates circular gear 270. Rotation of circular gear 270 causes one of protrusions 236*a–c* to frictionally engage lever 238 and rotate lever 238. Rotation of lever 238 rotates drive bar 18 causing bolt 14 to extend or retract, depending upon the direction of rotation.

For example, dead-bolt assembly 10 is shown in a locked position in FIG. 3. If an unlocking operation is desired using the electrically operated actuator assembly 212, motor 220 is driven such that circular gear 270 rotates in a counter-clockwise direction. Protrusion 236*a* contacts lever 238, forcing lever 238 to rotate drive bar 18 until bolt 14 retracts. After bolt 14 retracts, rotation of lever 238 is prevented by drive bar 18, which has fully rotated to its unlocked position.

Figure 3A:
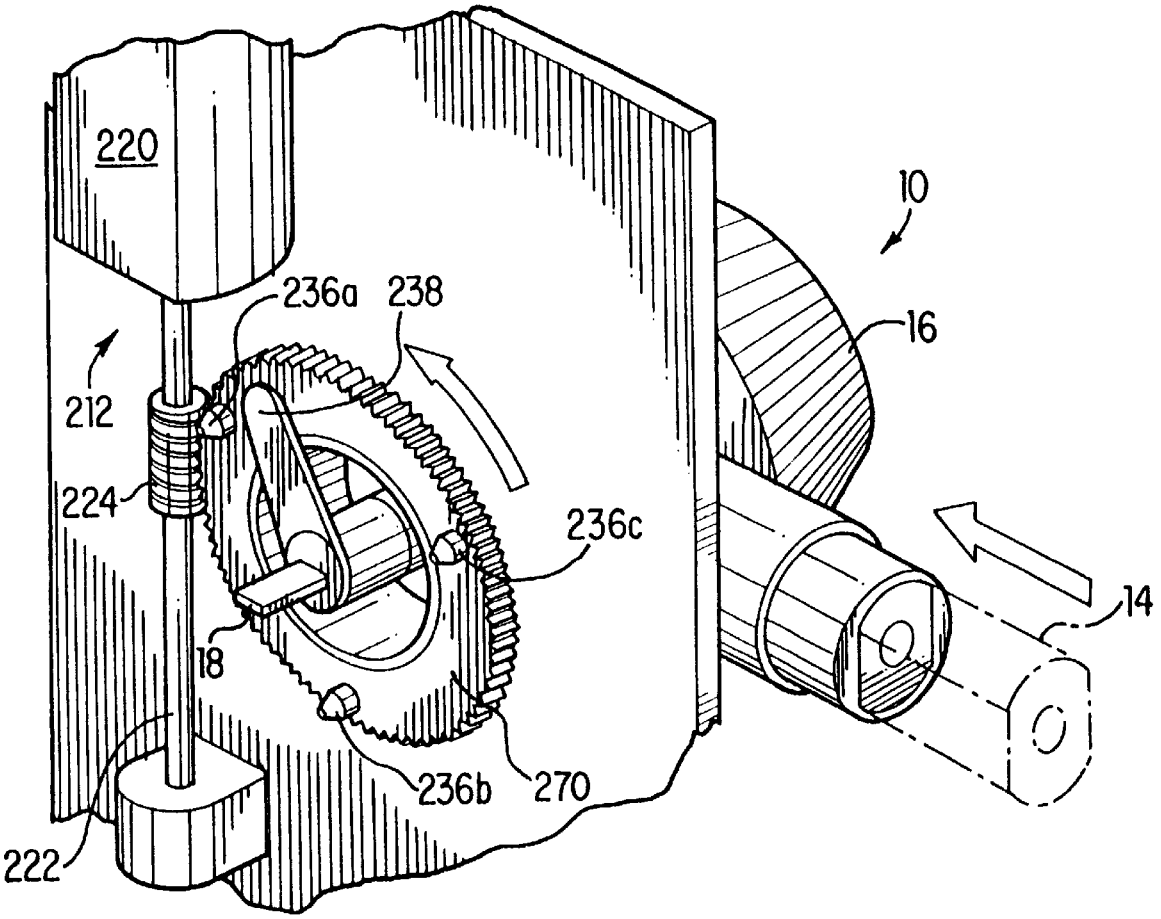
FIG. 3A is a perspective view of the dead-bolt assembly and actuator shown in FIG. 3, wherein the dead-bolt assembly is in the unlocked position.

However, motor 220 continues to drive circular gear 270 such that protrusion 236*a* causes lever 238 to bend outwardly, allowing protrusion 236*a* to be rotated beyond lever 238, as shown in FIG. 3A. Once protrusion 236*a* has extended just beyond lever 238, motor 220 is halted. As shown in FIG. 3A, the dead-bolt assembly is then in position to be manually operated or to be electrically operated by actuator 212.

In embodiments of the invention shown in FIGS. 1–3, the levers, 28, 128 and 238 are resilient to allow the electrically operated actuator assembly 212 to achieve a position whereby the actuator does not interfere with manual operation and such that the actuator is in position for the reciprocating operation. An alternative preferred embodiment is shown in FIG. 4, whereby no resilient member is required, thereby simplifying the design.

Figure 4:
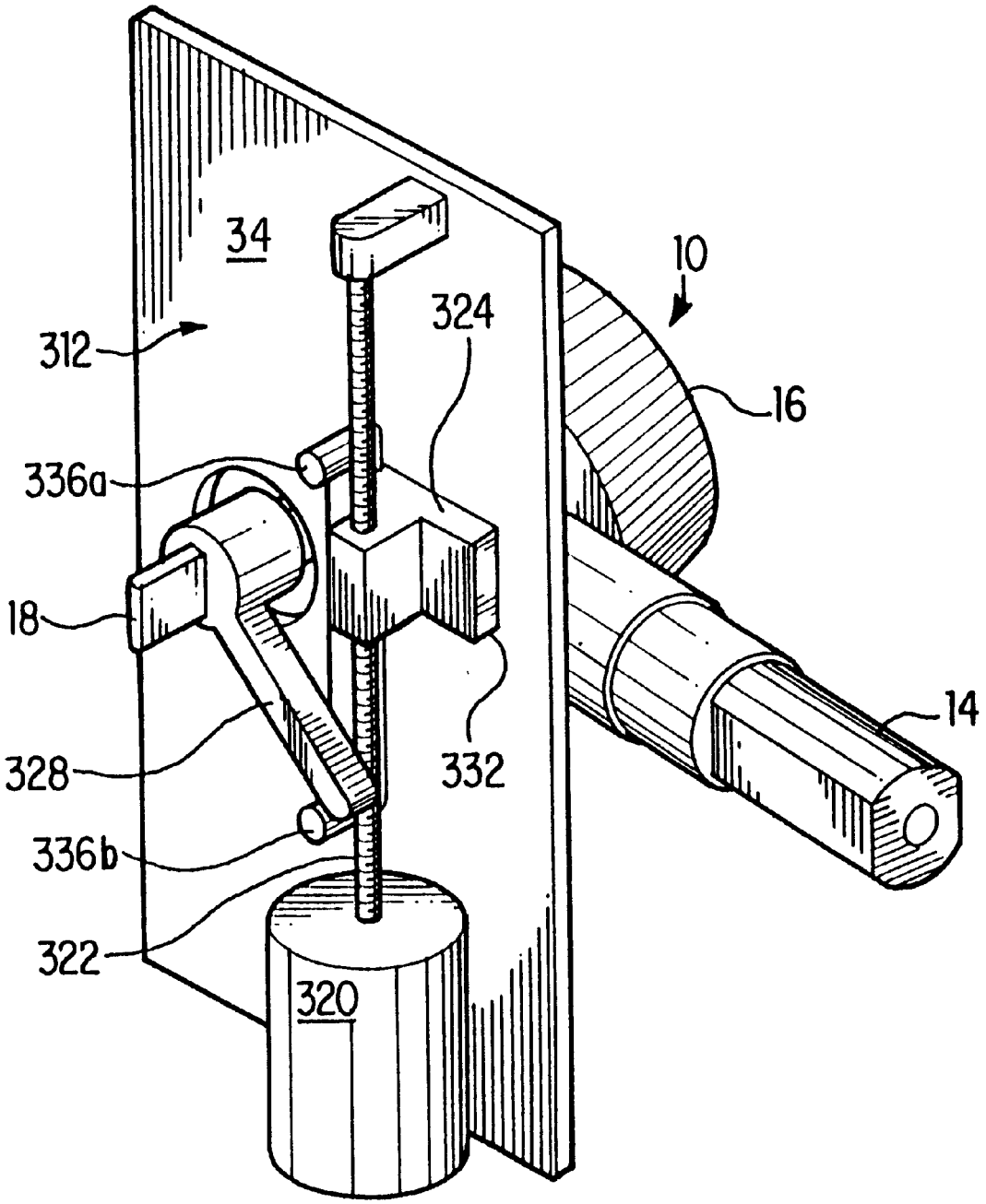
FIG. 4 is a perspective view of a dead-bolt assembly coupled with a fourth embodiment of an actuator in accordance with the present invention wherein the dead-bolt assembly is in the locked position.

FIG. 4 shows dead-bolt assembly 10 with an electrically operated actuator assembly 312 in accordance with the present invention. Actuator assembly 312 is mounted to plate 34 and includes motor 320, threaded rod 322 and a threaded actuating arm 324. Actuating arm 324 has a guide portion 332 that abuts against plate 34 preventing rotation of actuating arm 324. Actuating arm 324 has a first end portion 336*a* and a second end portion 336*b*. A lever 328 is secured to drive bar 18 to rotate drive bar 18 and extend or retract bolt 14, depending upon the direction of rotation. End portions 336*a–b* of actuating arm 324 are sized and positioned to define the ends of the range of rotation of lever 328.

Figure 4A:
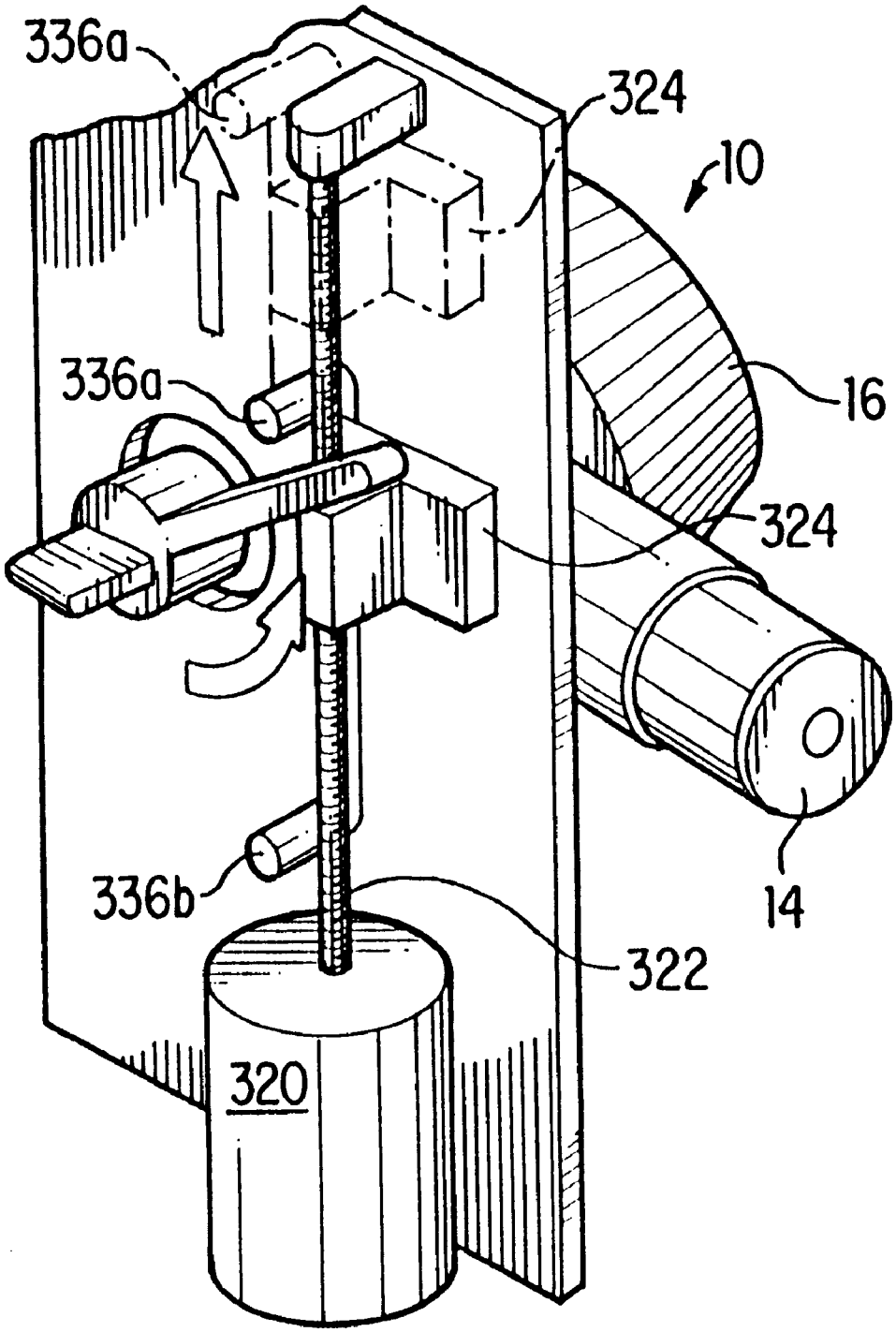
FIG. 4A is a perspective view of the dead-bolt assembly and actuator shown in FIG. 4, wherein the dead-bolt assembly is in the unlocked position.
Figure 4B:
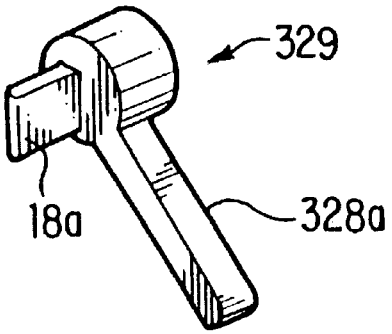
FIG. 4B is a front perspective view of a one-piece adaptor including a lever and extended drive bar for use with the embodiment shown in FIG. 4.

A preferred alternative to having a separate lever 328 that is secured onto the existing drive bar 18 is to provide a drive bar adaptor 329, as shown in FIG. 4B, which includes lever portion 328*a* and extended drive bar 18*a*. Extended drive bar 18*a* provides a physical extension of drive bar 18, making adaptor 329 particularly useful for retrofitting the actuator assembly 312 to an existing lock, which may have a relatively short drive bar. Similar drive bar adapters may be substituted for adaptor 26 and lever 28, lever 128 and lever 238.

Figure 4C:
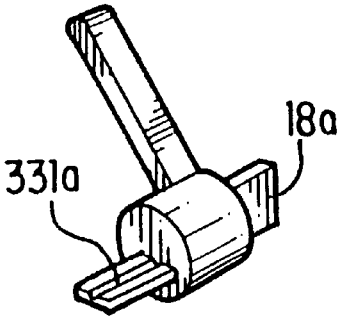
FIG. 4C is a back perspective view of an arrangement for the one-piece adaptor shown in FIG. 4B.
Figure 4D:
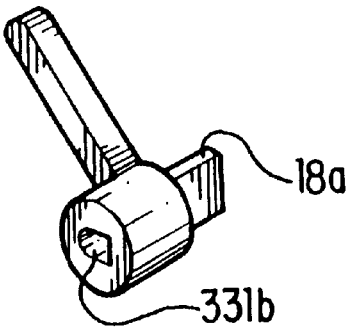
FIG. 4D is a back perspective view of an alternate arrangement for the one-piece adaptor shown in FIG. 4B.
Figure 4E:
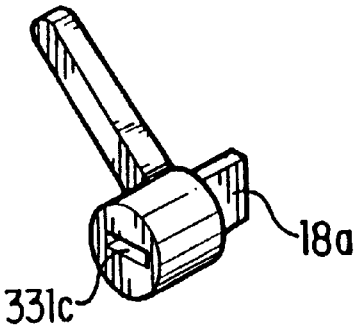
FIG. 4E is a back perspective view of another arrangement for the one-piece adaptor shown in FIG. 4B.

FIGS. 4C–4E shows alternate arrangements for the back portion of drive bar adaptor 329. The alternate arrangements are sized and configured to account for variations in drive bar arrangements from different lock manufacturers. An extended interior drive bar 331*a* is shown in FIG. 4C; a D-shaped hole 331*b* for receiving a D-shaped drive bar is shown in FIG. 4D; and a rectangular hole 331*c* for receiving a drive bar complimentary in shape is shown in FIG. 4E.

To effect a locking or unlocking operation, motor 320 is activated to rotate threaded rod 322, causing actuating arm 324 to move upward or downward along and parallel to threaded rod 322. Movement of actuating arm 324 causes end portions 336*a* or 336*b* to frictionally engage and rotate lever 328 causing rotation of drive bar 18 and the extension or retraction of bolt 14.

In FIG. 4, dead-bolt assembly 10 is shown in a locked position. To effect an unlocking operation, motor 320 is activated to drive actuating arm 324 in an upward direction. This causes end portion 336*b* to contact and rotate lever 328. Continued movement of actuating arm 324 rotates lever 328 until bolt 14 is completely retracted. Once the bolt 14 is fully retracted (see actuator arm in phantom in FIG. 4A), motor 320 automatically reverses its direction causing actuating arm 324 to move downward until it reaches the position shown in FIG. 4A. As readily seen in FIG. 4A, dead-bolt assembly 10 is in position to be manually operated or for a subsequent operation by electrically operated actuator assembly 312.

Figure 5:
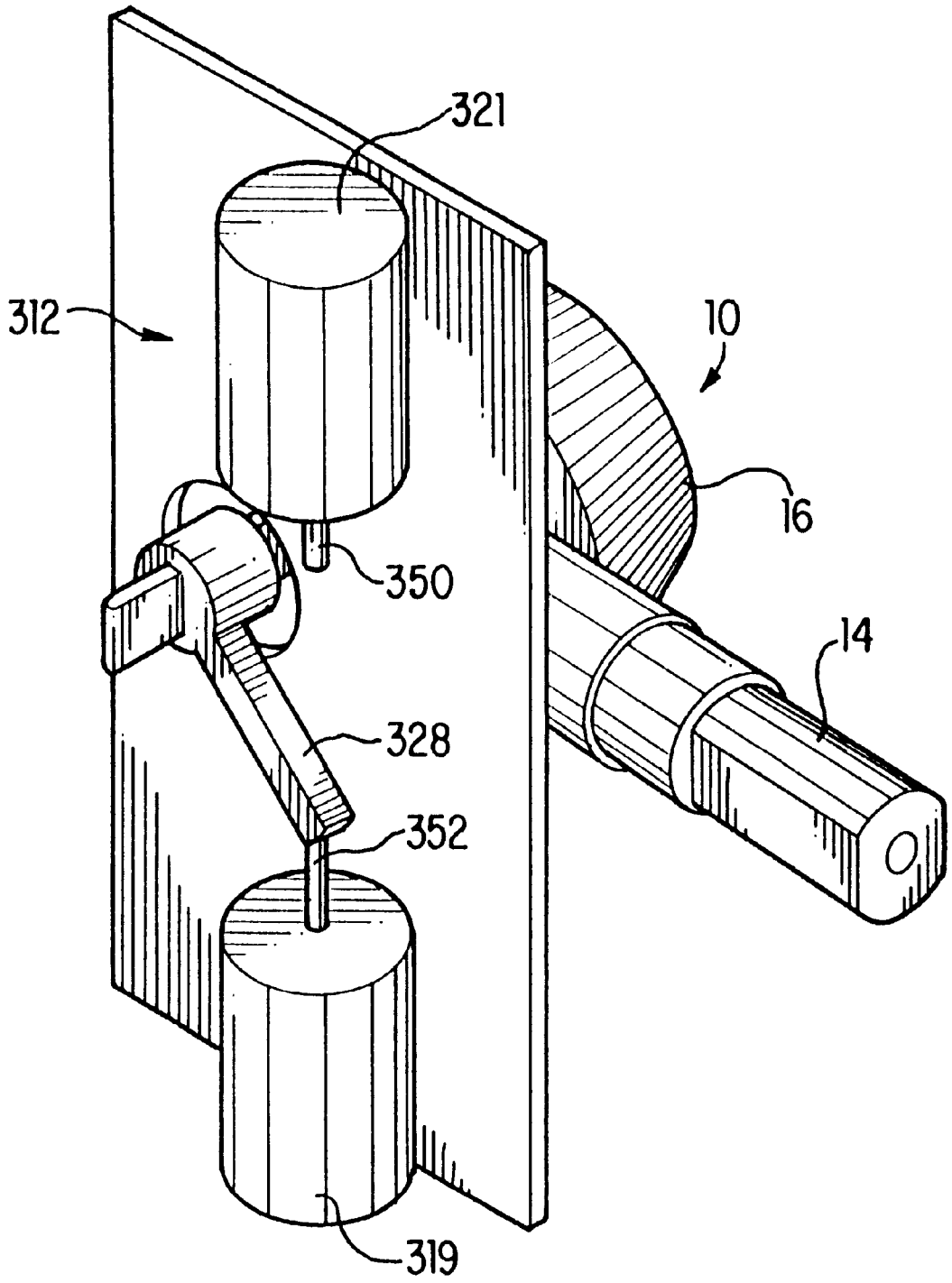
FIG. 5 is a perspective view of an alternative arrangement of the actuator embodiment shown in FIG. 4, wherein the alternative arrangement includes solenoids.

It will be appreciated by those skilled in the art that changes and modifications may be made to the embodiments described above without departing from the invention in its broader aspects. One such modification of the invention is shown in FIG. 5, wherein actuator assembly 312 shown in FIG. 4 is modified replacing motor 320 with two (2) solenoids 321, 319. Solenoid 319 has a core 352 that may be extended or retracted. Solenoid 319 is mounted such that core 352 may contact lever 328 and force it from the locked to the unlocked position. Solenoid 321 has a core 350 that is positioned such that it may contact lever 328 and force it from the locked to the unlocked position. FIG. 5 shows dead-bolt assembly 10 in the locked position. The dead-bolt assembly 10 is unlocked by actuating solenoid 319 such that core 352 pushes lever 328 such that drive bar 18 is rotated and bolt 14 is retracted. Then solenoid 319 is actuated such that core 352 is retracted. This places the assembly in position to be manually operated or electrically actuated. Similarly, a locking operation is affected by solenoid 321 being actuated to extend core 350 such that it rotates lever 328 causing the extension of bolt 14. Solenoid 321 is then actuated to retract core 350, placing the assembly in position for manual or subsequent automatic operation.

Figure 6:
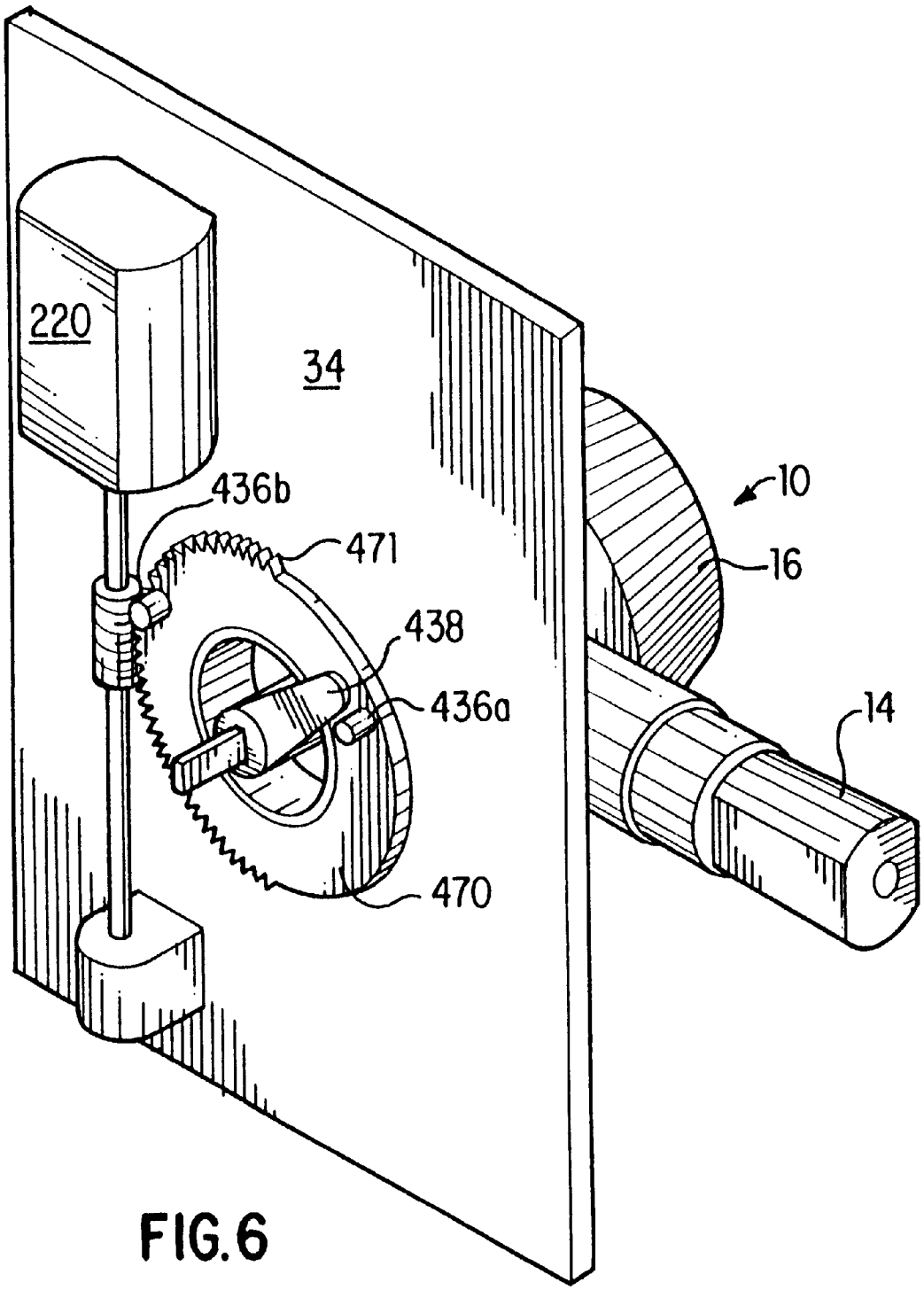
FIG. 6 is a perspective view of an alternative arrangement of the actuator embodiment shown in FIG. 3.

FIG. 6 shows a modification to the actuator embodiment shown in FIG. 3. Protrusions 236*a* and 236*b* are replaced with protrusions 436*a* and 436*b*, which are sized to extend beyond lever 438. A protrusion corresponding to 236*c* is not required. Additionally, gear 470 only needs approximately half as many teeth 471 as gear 270. Rigid lever 438 replaces lever 238 in this modification and need not be resilient, but may be resilient to facilitate fail-safe operation, as discussed below in conjunction with FIG. 13. FIG. 6 shows dead-bolt assembly 10 in the locked position. Assembly 10 is unlocked by activating motor 220 to rotate circular gear 470 counterclockwise, thereby rotating lever 438 causing drive bar 18 to retract bolt 14. Once bolt 14 has reached the completely retracted position, motor 220 automatically reverses turning circular gear 470 clockwise until gear 470 returns to its position shown in FIG. 6. Similarly, assembly 10 is locked by rotating circular gear 470 clockwise until bolt 14 completely extends, and then rotating circular gear 470 counterclockwise until gear 470 returns to its position shown in FIG. 6.

Figure 13:
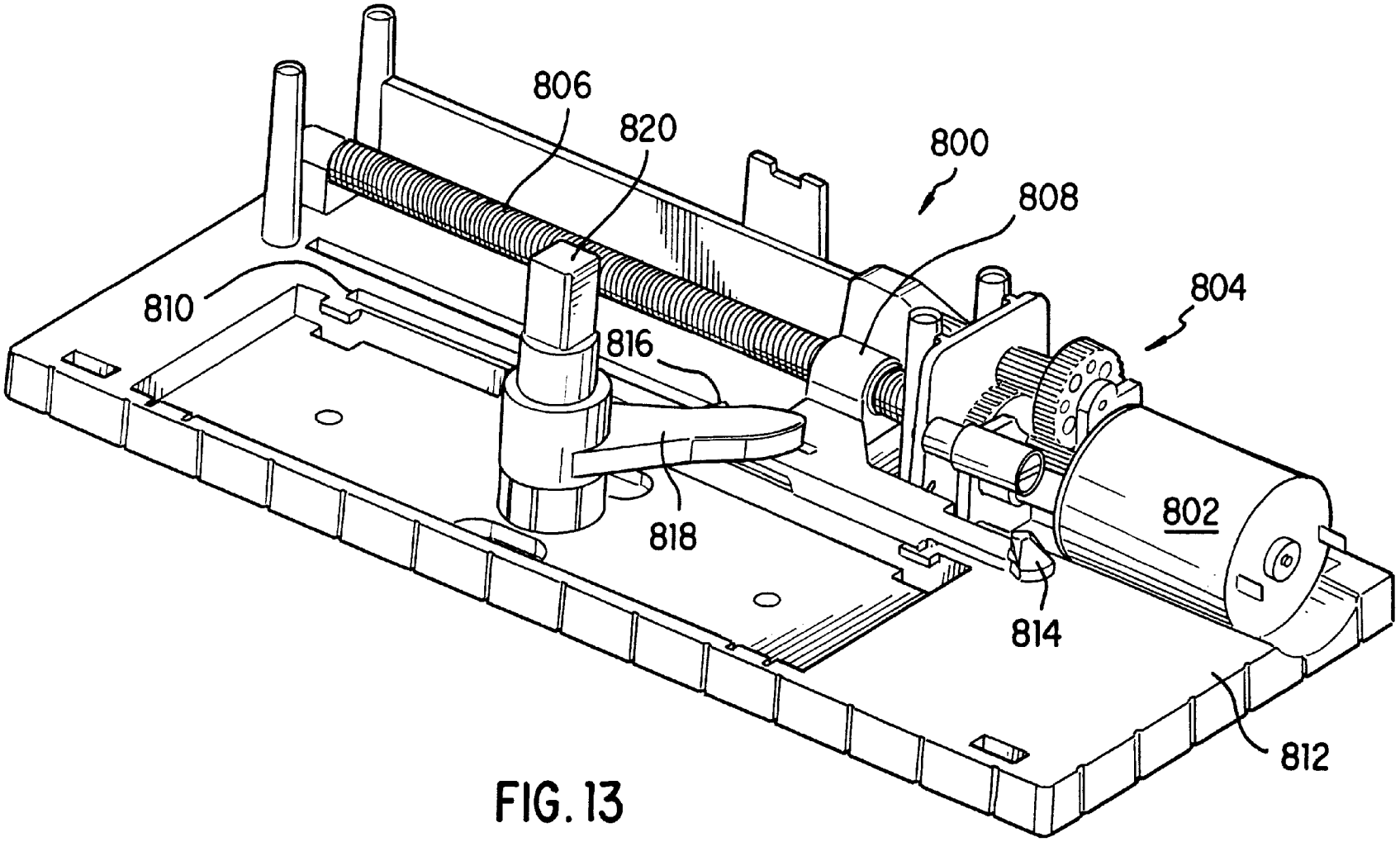
FIG. 13 is a perspective view of another electrically operated actuator embodiment in accordance with the present invention.

FIG. 13 is an additional preferred embodiment of an electrically operated actuator in accordance with the present invention. Electrically operated actuator 800 has a motor 802 that rotates an optional gear reduction assembly 804 that in turn rotates a threaded rod 806. An actuating arm or carriage 808 is in threaded engagement with threaded rod 806 such that actuating arm 808 travels along the length of threaded rod 806. Actuating arm 808 is prevented from rotating about threaded rod 806 due to a raised portion (not shown) on actuating arm 808 that rests within a groove 810 in base plate 812. Two angled protrusions 814, 816 are cantilevered on actuating arm 808 for rotating a lever 818, which in turn actuates drive bar 820, which rotates a conventional bolt mechanism (not shown).

The actuator 800 operates substantially as the actuator 312 shown in FIGS. 4–4A. The angled protrusions 814, 816 are sized and positioned to define the ends of the range of rotation of lever 818. To effect a locking or unlocking operation, motor 802 is activated to rotate threaded rod 806, causing actuating arm 808 to move upward or downward along and parallel to threaded rod 806. Movement of actuating arm 808 causes one of angled protrusions 814 or 816 to frictionally engage and rotate lever 818 causing rotation of drive bar 820 and the extension or retraction of the bolt. As with actuator assembly 312, motor 802 rotates in one direction to lock or unlock, then automatically reverses at the end of the desired operation to place the actuating arm in a neutral position to facilitate manual operation or subsequent electrical operation. The neutral position allows lever 818 to rotate within its range of movement without interference from actuating arm 808.

Angled protrusions 814, 816 provide additional advantages for fail-safe operation of actuator 800 by allowing manual locking and unlocking operation even when the actuating arm is not in a neutral position. For example, if actuator 800 fails with actuating arm in the position shown in FIG. 13, lever 818 may be forced counterclockwise, pushing the cantilevered angled protrusion out of its path to effect a lock or unlock operation. Angled protrusions 814, 816 are angled on one side at a different slope than the other side to present different levels of force to overcome the actuating arm in case of failure. Thus, after a lock or unlock operation that forces lever 818 from between angled protrusions 814, 816, less force is required to return lever 818 to a position between angled protrusions 814, 816. An alternative to a rigid lever, such as lever 818, and cantilevered angled protrusions 814, 816, is to have a resilient lever such as lever 238 and rigid protrusions on actuating arm 808.

The electronic controls for activating and deactivating the actuator assembly in accordance with the present invention may be accomplished in any known manner. Preferably, the actuator is controlled by a remote control transmitter and receiver which, for example, may operate using radio frequency (RF). Alternatively, the actuator may be controlled by a keypad collocated or remote from the lock.

Figure 7:
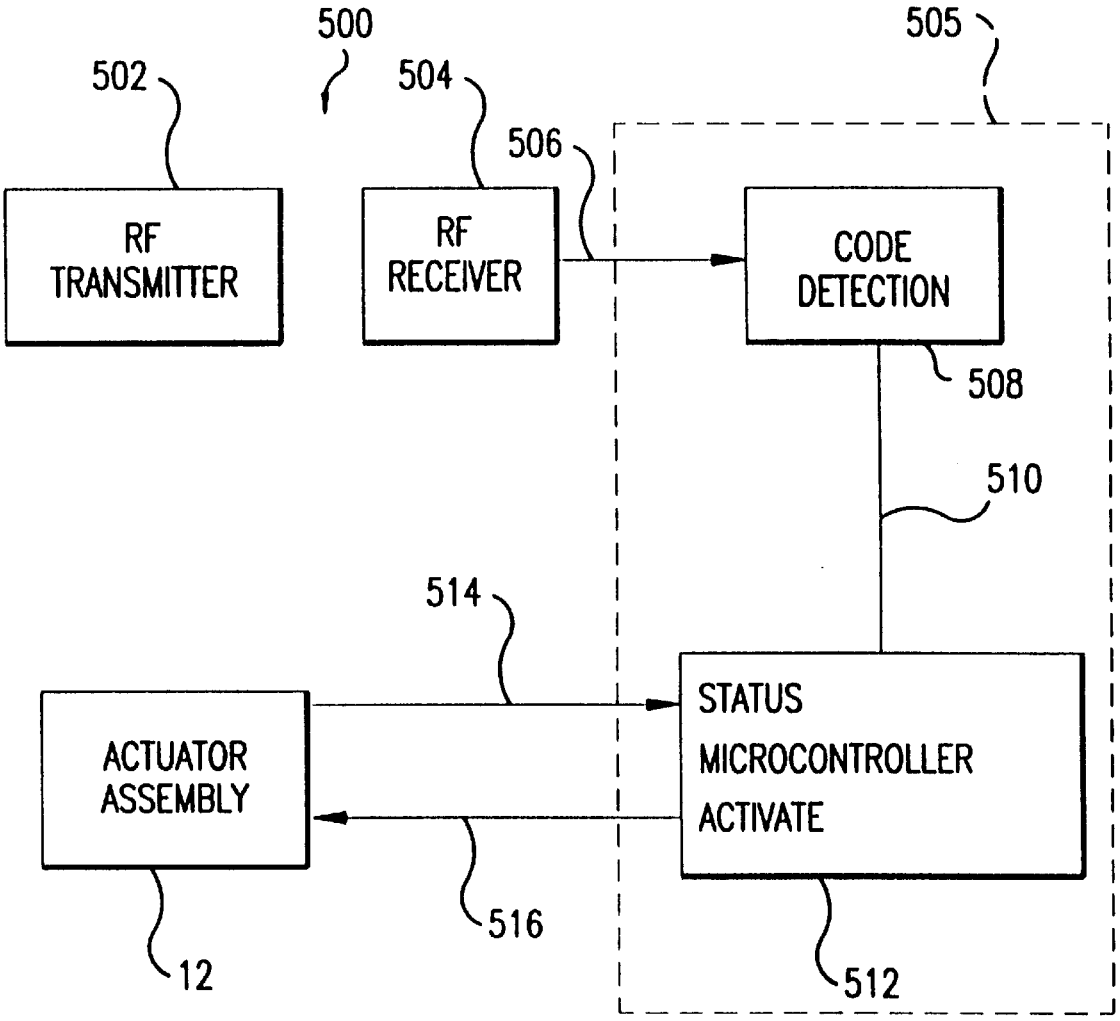
FIG. 7 is a block diagram of a remote control system that controls an actuator in accordance with the present invention.

FIG. 7 is a block diagram illustrating an embodiment for controlling actuator assembly 12. A circuit 500 is composed of an RF transmitter 502, RF receiver 504, and a control circuit 505, including a code detection circuit 508 and microcontroller 512. RF transmitter 502 transmits, via radio frequency, preferably encrypted codes to lock and unlock the actuator assembly. Preferably, RF transmitter 502 is of the type commonly used with automobile locks. RF receiver 504 receives radio frequency signals transmitted by transmitter 502 and creates a demodulated signal 506 that is transmitted to code detection circuit 508. Code detection circuit 508 determines whether a valid signal was received from the transmitter 502. A valid/nonvalid indication 510 is transmitted by code detection circuit 508 to microcontroller 512. If a valid signal was received, microcontroller 512 deciphers the command requested. Microcontroller 512 then sends the appropriate activation signals 516 to the actuator assembly to lock or unlock the actuator assembly. Microcontroller 512 also monitors the status of the actuator assembly via status signals 514. As an alternative to a separate code detection circuit, the microcontroller may implement the code detection circuit.

Figure 8:
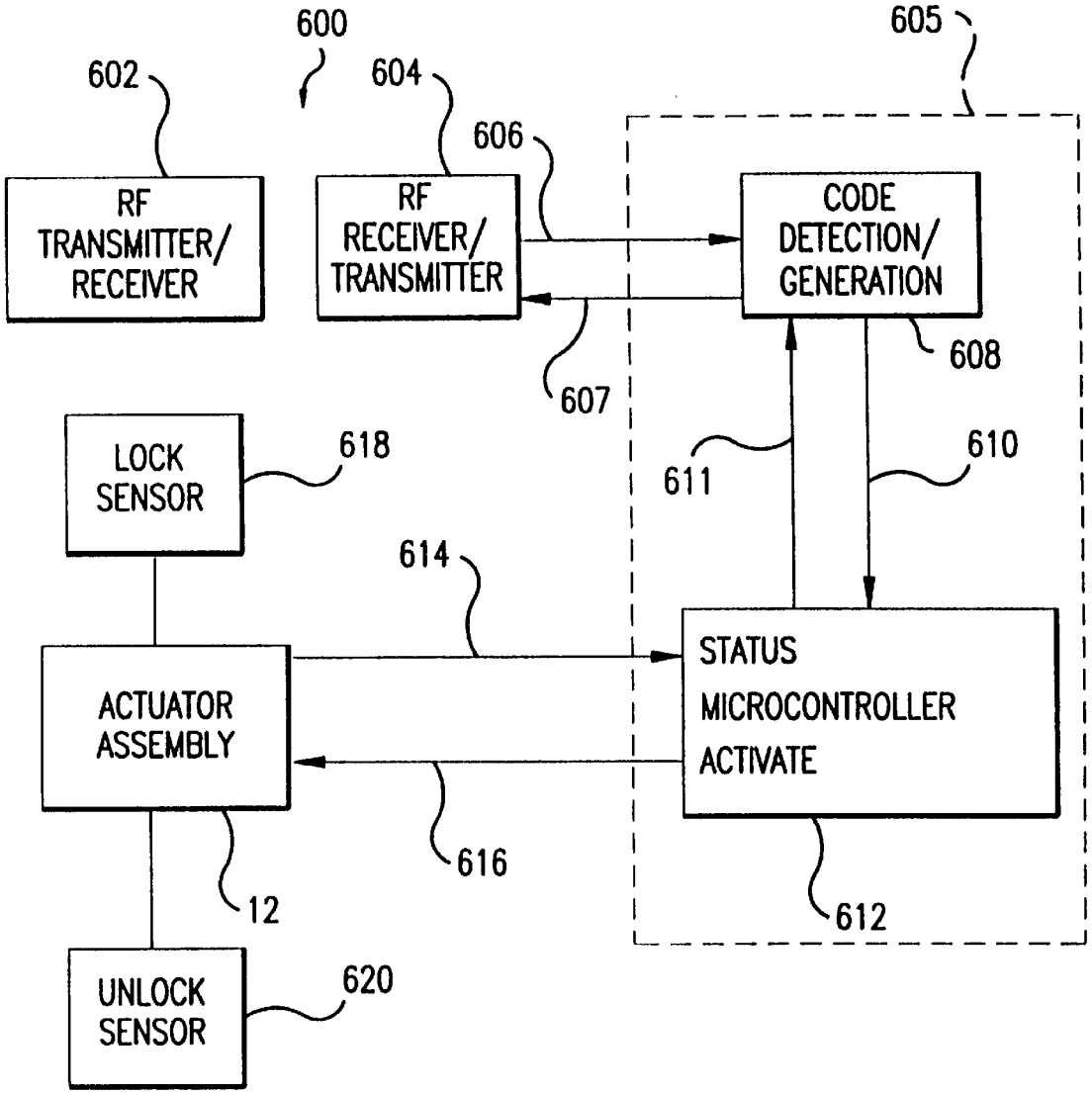
FIG. 8 is a block diagram of a remote control system that controls and reports status of an actuator in accordance with the present invention.

FIG. 8 is a block diagram illustrating a preferred embodiment for controlling actuator assembly 12 and receiving status information from actuator assembly 12. A circuit 600 is composed of two transceivers, an RF transmitter/receiver 602 and RF receiver/ transmitter 604, and a control circuit 605, including a code detection/generation circuit 608 and microcontroller 612. Additionally, for sensing the status of the actuator assembly, lock sensor 618 and unlock sensor 620 are provided.

For controlling actuator assembly 12, circuit 600 operates in a manner similar to circuit 500. RF transmitter/receiver 602 transmits, via radio frequency, preferably encrypted codes to lock and unlock the actuator assembly. RF receiver/transmitter 604 receives radio frequency signals transmitted by transmitter/receiver 602 and creates a demodulated signal 606 that is transmitted to code detection/generation circuit 608. Code detection/generation circuit 608 determines whether a valid signal was received from transmitter/receiver 602. A valid/nonvalid indication 610 is transmitted by code detection/generation circuit 608 to microcontroller 612. If a valid signal was received, microcontroller 612 deciphers the command requested. Microcontroller 612 then sends the appropriate activation signals 616 to the actuator assembly to lock or unlock the actuator assembly.

Lock sensor 618 and unlock sensor 620 are provided to detect the status of the dead-bolt assembly and the actuator assembly. Lock sensor 618 provides an indication that the dead-bolt assembly has been successfully locked. Unlock sensor 620 provides an indication that the dead-bolt assembly has been successfully unlocked. The sensors may be reed switches with a magnet, Hall effect switches with a magnet, optical sensors, metal electrical contacts, or mechanical switches. The sensors may sense, for example, the position of the actuating arm or the lever or both. Additional sensors may be used to sense additional positions of the actuator assembly or lock.

The status of the actuator assembly and the lock as determined from any sensors, such as lock sensor 618 and unlock sensor 620, may be transmitted to the microcontroller via status signals 614. Microcontroller 612 may alert code detection/generation circuit 608 to generate an appropriate status signal via status line 611. Code detection/generation circuit 608 may then create a modulated signal 607 which is transmitted via RF receiver/transmitter 604 to RF transmitter/ receiver 602. The status received by RF transmitter/receiver 602 may be used to generate a visual or audible indication of status to the user.

The electronics for controlling the actuator assembly in accordance with the present invention are preferably battery powered and most preferably, include a visual and/or audible indication of a low battery condition.

Figure 14:
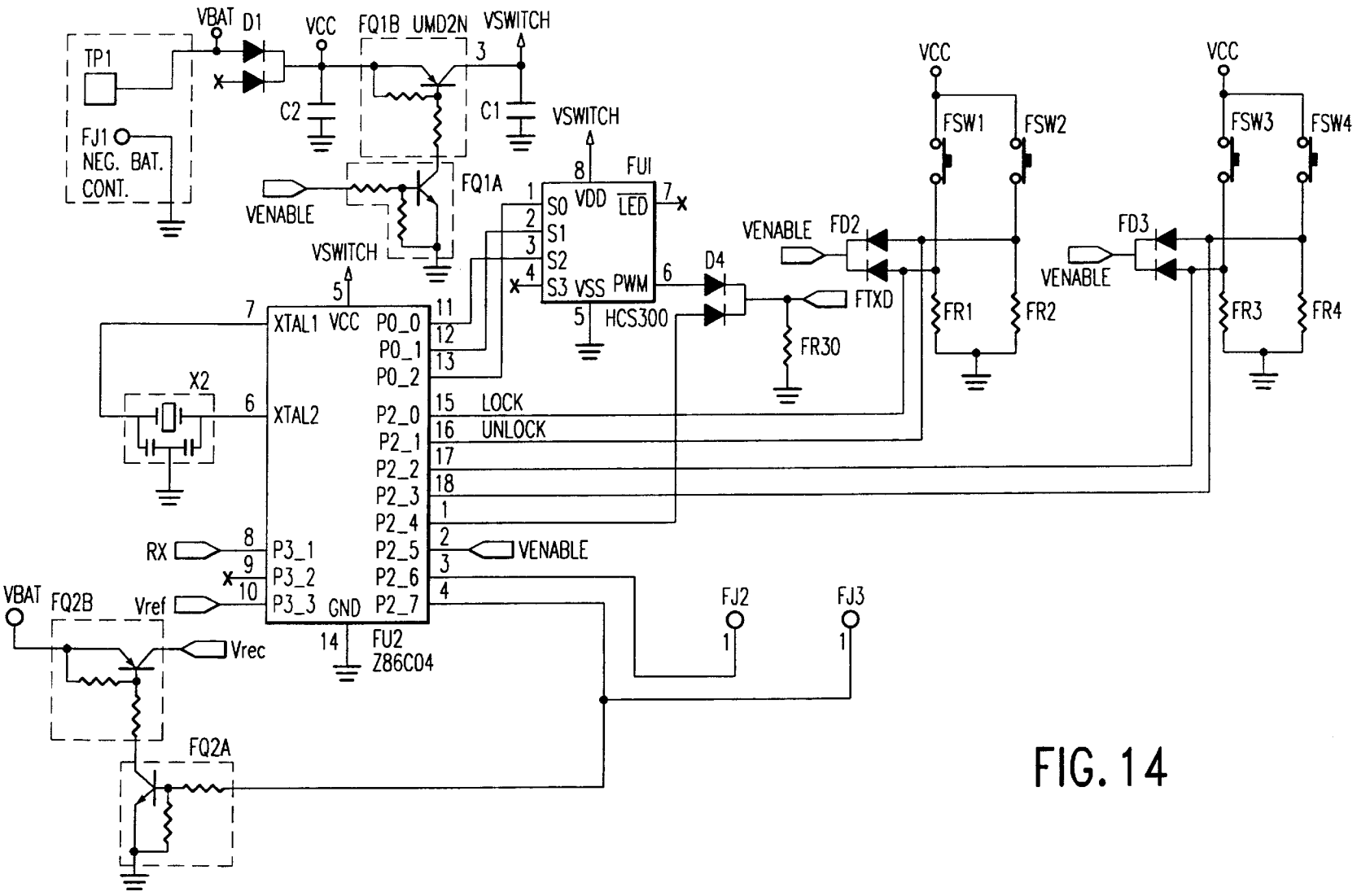
FIG. 14 is a schematic diagram of an embodiment implementing control circuitry for a remote control for use with an actuator in accordance with the present invention.
Figures 15, 16:
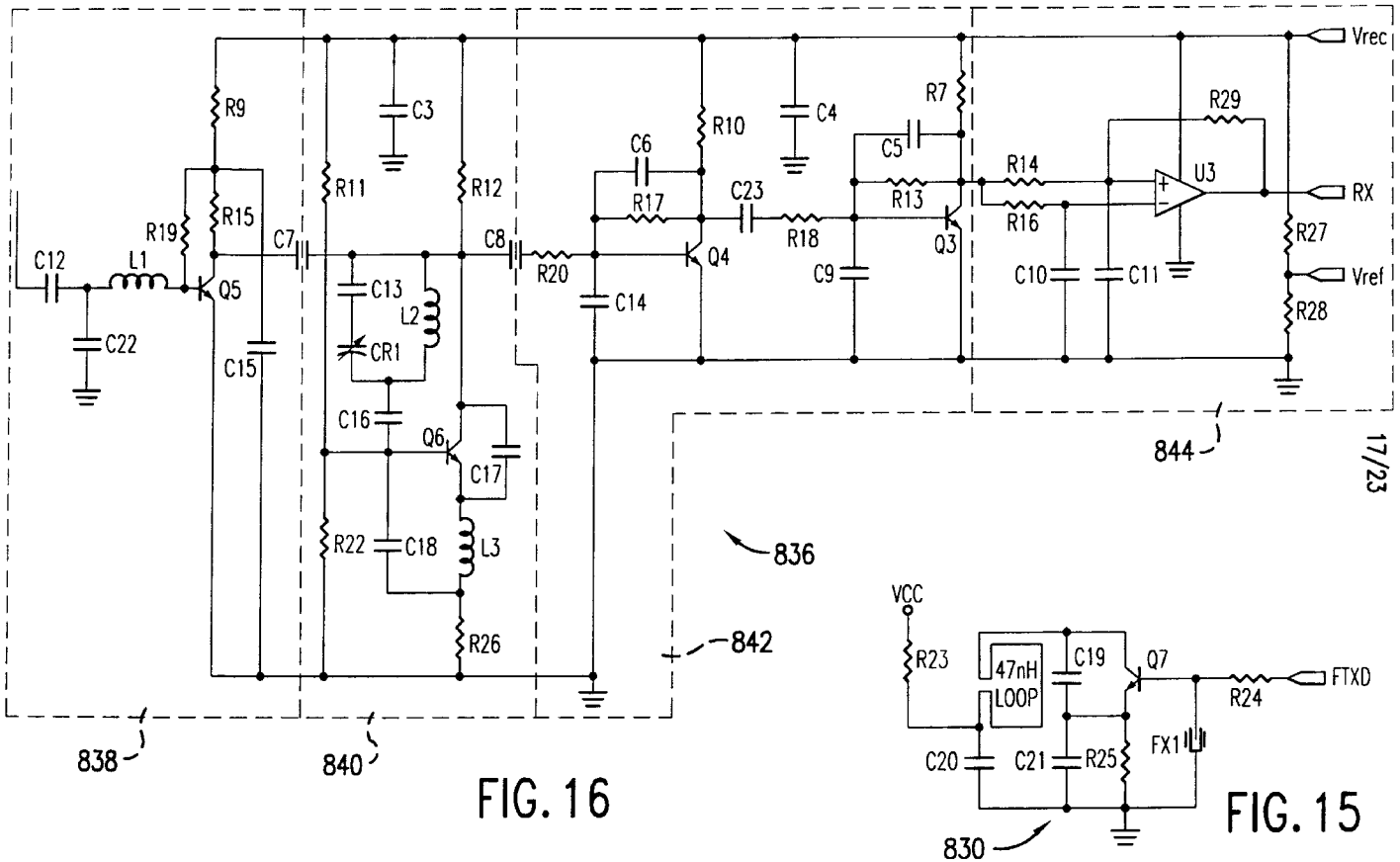
FIG. 15 is a schematic diagram of a transmitter for a remote control for use with an actuator in accordance with the present invention.
FIG. 16 is a schematic diagram of a receiver for a remote control for use with an actuator in accordance with the present invention.
Figure 17:
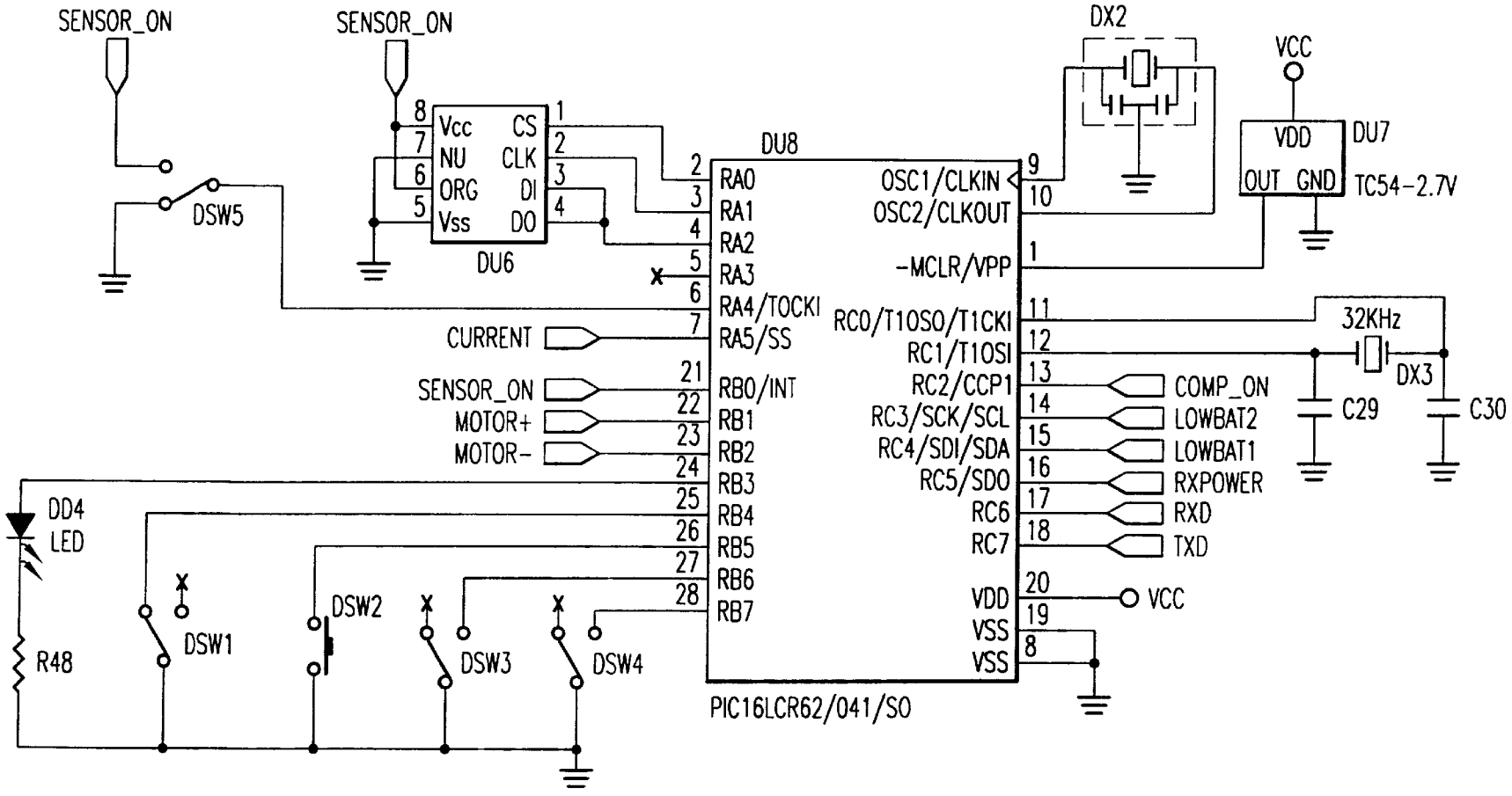
FIG. 17 is a schematic diagram of a portion of the control circuitry of a door unit including an actuator in accordance with the present invention.
Figure 18:
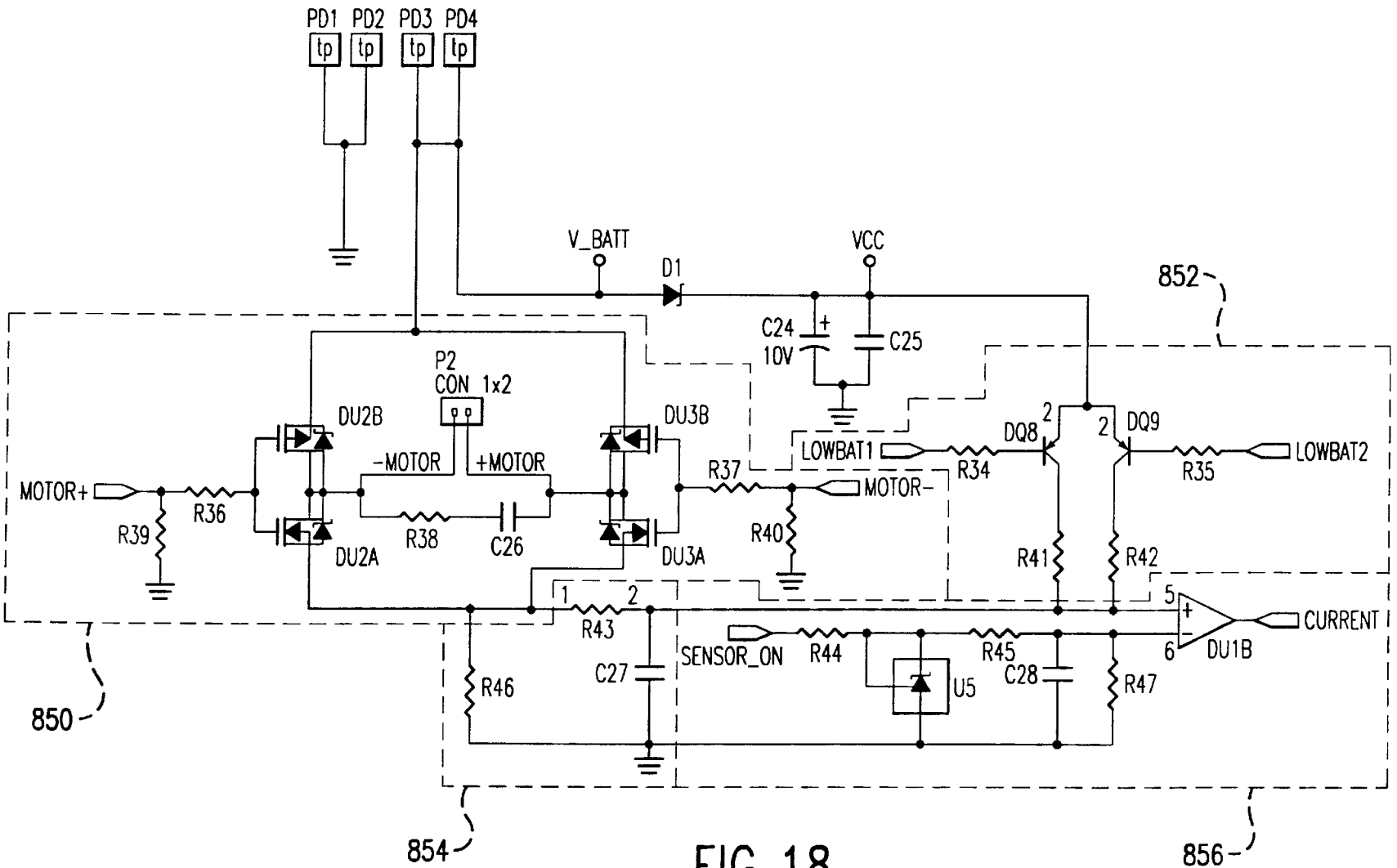
FIG. 18 is a schematic diagram of a portion of the control circuitry of a door unit including an actuator in accordance with the present invention.
Figures 19, 20:
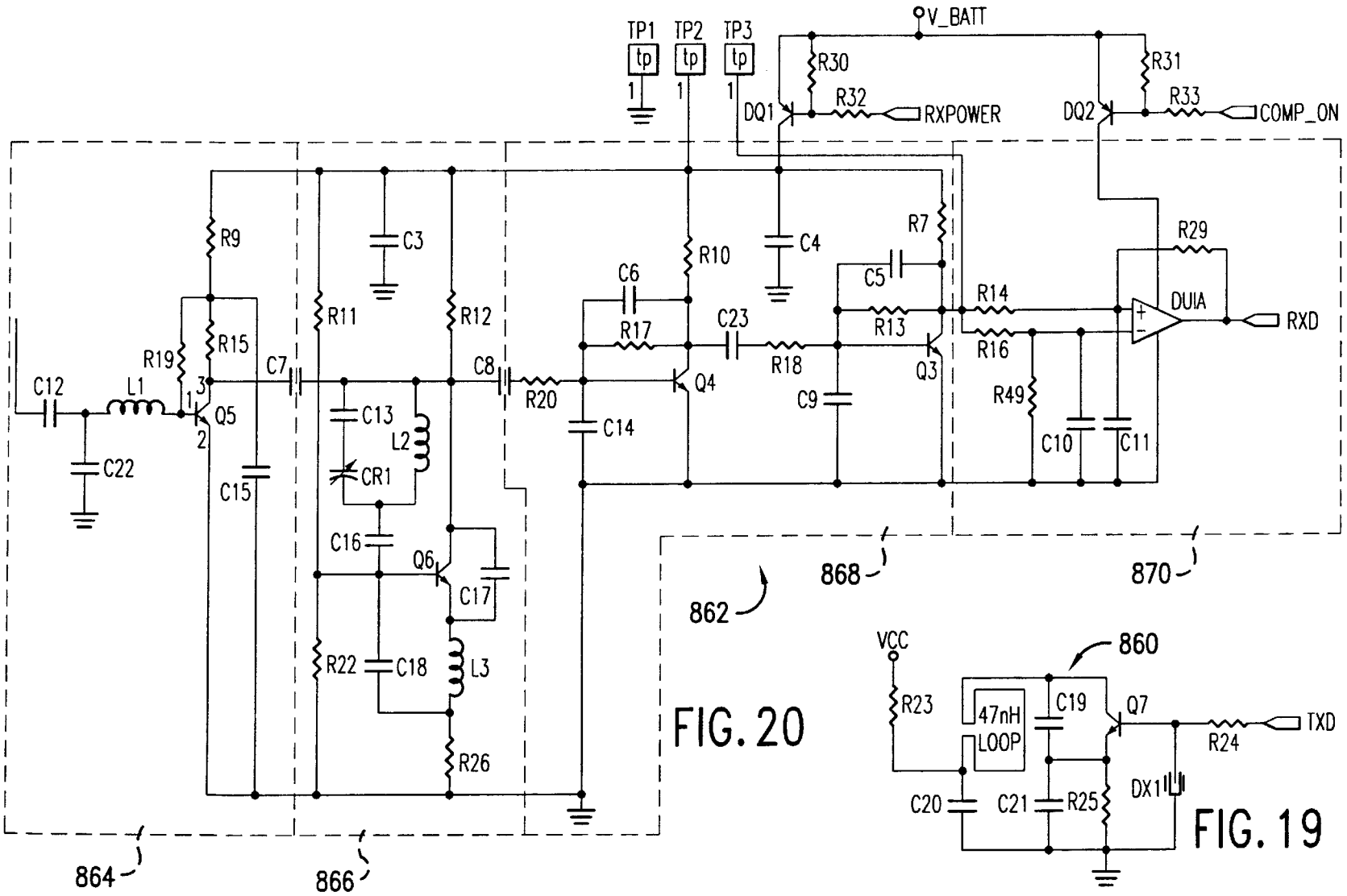
FIG. 19 is a schematic diagram of a transmitter for a door unit including an actuator in accordance with the present invention.
FIG. 20 is a schematic diagram of a receiver for a door unit including an actuator in accordance with the present invention.

FIGS. 14–20 are schematic diagrams of a preferred embodiment for implementing the electronics for controlling the actuator assembly in accordance with the present invention. FIGS. 14–16 are the schematic diagrams for the remote control or fob used to send signals to the actuator and receive status signals from the actuator. FIG. 14 is the schematic for the control circuitry for the fob and FIGS. 15 and 16 are the schematics for the transmitter and receiver, respectively, for the fob. FIGS. 17–20 are the schematic diagrams for the door unit lock circuitry, which includes the electronics located with the actuator assembly for controlling the actuator and receiving and transmitting signals from and to the fob. The door unit control circuitry is shown in FIGS. 17–18 and the transmitter and receiver portions of the door unit circuitry are shown in FIGS. 19 and 20, respectively.

Referring to FIG. 14, the remote control or fob has four switches FSW1, FSW2, FSW3, FSW4 and is battery operated. The terminals for the battery are FTP1 and FJ1, representing positive and negative, respectively. At the heart of the fob control circuitry is a microprocessor FU2. The preferred microprocessor is a Z86C04 available from Zilog. However, any suitable microprocessor may be used.

Microprocessor FU2 has power and ground inputs, VCC and GND, clock/crystal inputs XTAL1–2 and general purpose input/output ports P0, P2 and P3. Port inputs P0_0–2 are used to interface to a hopping encoder FU1, which is preferably a HCS300 from Microchip. Hopping encoder FU1 is used to encrypt the data that will be transmitted by the fob. Port P2_4 is used as an output to generate an unencrypted transmit signal. The transmit signal FTXD, which may be derived from port P2_4 and/or hopping encoder FU1, is sent to the transmitter circuit (FIG. 15) for transmission.

Ports P2_0–3 are inputs connected to switches FSW1, FSW2, FSW3 and FSW4, respectively. The switches FSW1–4 are normally open contacts that when closed place VCC on the corresponding port inputs. The switch inputs allow the user to give commands such as lock and unlock to microprocessor FU2. As an alternative to switches for the user to enter commands, a keypad or other input device may be used.

Ports P2_6 and P2_7 are used to provide a voltage to two contacts FJ2, FJ3 of a buzzer for generating an audio alarm. Adjusting the frequency of the signals from microprocessor FU2 ports P2_6 and P2_7 will change the tone of the buzzer. Port P2_7 has a dual use for switching on power to the receiver to receive signals from the door lock unit. Power is switched on to the receiver by driving P2_7 high, turning on transistor FQ2A, which in turn switches on transistor FQ2B, which places signal VREC at approximately the voltage of VBAT, the positive voltage from the battery.

Port P3_1 is an input for receiving data RX from the receiver. Data RX is deciphered by microprocessor FU2 to determine any message or signal sent from the door unit. The message may be, for example, to generate an audible alarm through the buzzer.

To conserve as much battery power as possible, power to the fob circuitry is enabled only when required. When any of the four switches FSW1–4 is activated, signal VENABLE is driven high to turn on transistor FQ1A, which turns on transistor FQ1B, applying power through VSWITCH to microprocessor FU2. Upon power up, microprocessor FU2 outputs a logic high on port P2_5, which is tied to the signal VENABLE. This maintains power after the switch is released. When microprocessor FU2 has completed the command requested by the user it can power itself down by placing VENABLE in a high impedance state.

FIG. 15 shows the transmitter for the fob. Transmitter 830 generates a pulse-width modulated radio frequency signal based on signal FTXD. A saw resonator FX1 sets the frequency and a loop of approximately 47 nanohenries, implemented as a circuit trace on the board, provides the antenna for the transmitter. The signal FTXD, generated from microprocessor FU2 in combination with hopping encoder FU1, is the input signal that is modulated by transmitter 830.

Receiver 836, shown in FIG. 16, receives signals from the door unit, such as a verification that a locking operation has occurred successfully. Receiver 836 has a preamplifier 838, a super-regenerative, self-quenching oscillator 840, gain and filtering stage 842, and a data slicer or data comparator 844. Receiver 836 is selectively powered by signal VREC, which is generated from transistor FQ2B when transistor FQ2A is turned on by microprocessor FU2 driving port P2_7 (FIG. 14).

FIGS. 17–18 are schematics for the door unit control circuitry that controls and senses the status of the lock and deciphers and generates the transmitted and received signals. The door unit control circuitry is also battery operated. The positive battery terminals are PD3 and PD4. The ground battery terminals are PD1 and PD2.

The major circuit blocks included with the control circuitry are motor control circuit 850, low battery sensing circuit 852, motor current sensing circuit 854, sensing switches, DSW1, DSW3, DSW4, common sense circuit 856, EEPROM DU6, and microprocessor DU8. Low battery sensing circuit 852 and motor current sensing circuit 854 share common sense circuit 856, including comparator DU1B. Microprocessor DU8 uses its ports to control or sense the status of the other circuit blocks.

Microprocessor DU8 has clock inputs OSCI/CLKIN and OSC2/CLKOUT connected to a crystal DX2 to provide the clock for normal operation. Microprocessor DU8 also has clock inputs RCO/T1OSO/T1CK1 and RC1/T1OSI, which are attached to a 32 kilohertz crystal DX3, that provides the low power clock for a sleep mode for microprocessor DU8. The power clear input MCLR/VPP is connected to a voltage detector DU7 that resets microprocessor DU8 if there is a drop in voltage. The door unit control circuit includes an EEPROM DU6 for storing the fob serial numbers used to determine whether a signal being received is from an authorized or valid fob. Microprocessor DU8 ports RA0, RA1, RA2 provide a serial interface to EEPROM DU6. RA0 is driven by microprocessor DU8 to provide the chip select signal CS and RA1 is similarly driven by microprocessor DU8 to provide the clock input CLK to EEPROM DU6. The data in DI and data out DO pins of the EEPROM are controlled by port RA2 of microprocessor DU8.

Microprocessor DU8 preferably is a PIC16LCR62/04I/SO processor available from Microchip. Most preferably microprocessor DU8 has program memory on chip in the form of a ROM. The program memory is used to implement the algorithm for operating and controlling the door unit control circuitry.

Ports RB1, RB2 and RA4/TOCKI are the primary inputs and outputs for controlling the operation of the motor. Port RA4/TOCKI is connected to switch DSW5 which is used to select whether the lock is connected to a left or a right-hand door. This is used to determine the direction that the motor must turn to lock or unlock. Port RB1 is the MOTOR+ output and port RB2 is the MOTOR− output to motor control circuit 850. The terminals to the motor are connected at connector P2 of motor control circuit 850. The MOTOR+ and MOTOR− outputs drive power FETS DU2A, DU2B, DU3A, DU3B, which control the direction of rotation for the motor. If microprocessor DU8 places the MOTOR+ and MOTOR− outputs in the high and low states, respectively, the motor is turned on in the + direction. If the MOTOR+ and MOTOR− outputs are both placed in the low state or both placed in the high state, then the motor is off. If the MOTOR+ and MOTOR− outputs are placed in the low and high states, respectively, the motor is turned on in the − direction Whether the + direction or − direction of the motor locks or unlocks is determined by switch DSW5.

Switches DSW1, DSW3 and DSW4 are used to sense the status of the lock. DSWL is a normally closed, single-pole, double-throw switch used to detect whether the actuator is in a neutral position. Switches DSW3 and DSW4 are normally open, single-pole, double-throw switches that are switched to determine the lock and unlock state, respectively. The switches may be used to sense, for example, the actuating arm or a lever used to rotate the drive bar of the lock.

Switch DSW2 is a single-pole, single-throw switch or contact used to force the microprocessor DU8 into a mode to learn fob or erase fob serial numbers in conjunction with the EEPROM DU6.

An LED DD4 is driven from microprocessor port RB3 and may be used to indicate the status of the door unit, including status about the lock or battery.

Common sense circuit 856, low battery sensing circuit 852, and motor current sensing circuit 854 sense low battery conditions and also current conditions in the motor circuit. Low battery sensing circuit 852 has two inputs, LOWBAT1 and LOWBAT2, connected to microprocessor DU8 ports RC3/SCK/SCL and RC4/SDI/SDA, respectively. Common sense circuit 856 is used to detect current status as well as low battery status. Comparator DULB has its output CURRENT connected to microprocessor DU8 input port RA5/SS. To save power consumption, the sensing circuitry is only enabled by microprocessor DU8 under control of a program when it is desired to sense certain conditions. The sensor output SENSOR_ON from the microprocessor port RBO/INT is turned on by microprocessor DU8 whenever a sensing operation is desired. The result of the sensing operation is returned to the microprocessor DU8 by the CURRENT output from comparator DU1B. The power to comparator DU1B is controlled by microprocessor DU8 port RC2/CCP1 (the connection is not shown). When the motor is turned on, current sensing circuit 854 detects the current through the motor by converting the current to a voltage. When the motor is turned off, low battery conditions may be detected sequentially by activating the LOWBAT1 and LOWBAT2 signals in conjunction with SENSOR_ON. The resistor values for R41 and R42 are used to determine the voltage thresholds that will activate the CURRENT signal when LOWBAT1 and LOWBAT2 are activated to turn on transistors DQ8 and DQ9, respectively.

The transmitter 860 and receiver 862 on the door lock unit are shown in FIGS. 19 and 20, respectively. The power to the receiver is controlled by a microprocessor DU8 port RC5/SDO, which drives signal RXPOWER. The transmit signal TXD is generated from microprocessor DU8 port RC7 and the received signal RXD is received at microprocessor port RC6.

The receiver 862 and transmitter 860 are similar to the receiver 836 and transmitter 830 of the fob unit, described above with respect to FIGS. 15–16. The receiver has a preamplifier 864, a super-regenerative, self-quenching oscillator 866, gain and filtering stage 868, and a data slicer or data comparator 870. Power to the receiver is controlled by input RXPOWER from microprocessor DU8, which is used to turn on transistor DQ1. Similarly, the power to comparator DU1A, which converts the received signal to digital logic levels, is controlled by the COMP_ON signal which turns on transistor DQ2.

The transmitter 860, transmits a pulse-width modulated signal. The frequency is set by saw resonator DX1 and a loop of approximately 47 nanohenries, implemented as a trace on the circuit board, is used as an antenna.

The operation of the electronics for the fob and door unit, shown schematically in FIGS. 14–20, may be better understood through the description of one example cycle of operation, such as a lock or unlock request operation. Those skilled in the art will readily recognize that the microprocessor based architectures of the fob and door unit allow considerable flexibility in the control and sensing of status of the actuator.

A user may make a request for a lock or unlock operation by depressing one of the contact switches FSW1, FSW2, FSW3, FSW4.

This causes the VENABLE signal to become active, which in turn activates transistor FQ1A and transistor FQ1B to power signal VSWITCH. Signal VSWITCH powers microprocessor FU2 and hopping encoder FU1. After receiving power, microprocessor FU2 asserts the VENABLE signal to maintain power.

Microprocessor FU2, under software control, decodes the user's request based on the switch depressed. Based on the request, for example lock or unlock, decoded by microprocessor FU2, an appropriate signal is generated to be transmitted. The signal may be encoded by using hopping encoder FU1 or may be sent unencoded using port P2_4 to generate signal FTXD, which is then converted into a pulse-width modulated RF signal by transmitter 830. Preferably, an unencoded preamble signal is sent first, then followed by an encoded signal.

The signal transmitted by transmitter 830 is received by receiver 862 of the door unit. The received signal is amplified by preamplifier 864, then sensed by super-regenerative self-quenching oscillator 866. The remaining signal is amplified by gain and filtering stage 868 and finally converted into digital logical levels by data slicer 870. Receiver 862 and comparator DU1A are powered by activation of RXPOWER and COMP_ON from microprocessor DU8 of the door unit. RXPOWER and COMP_ON are activated periodically every 200 milliseconds for 2–5 milliseconds to detect a preamble. If a preamble is detected then microprocessor DU8 maintains power until the signal from transmitter 830 is completely received.

Data slicer 870 outputs the received signal RXD to microprocessor DU8. Microprocessor DU8 deciphers the signal RXD to determine whether the signal was received from a valid fob. This is accomplished by the microprocessor DU8 first powering signal SENSOR_ON to compare the serial number transmitted in signal RXD with the valid serial numbers stored in EEPROM DU6. If the signal transmitted by the fob is appropriate, then microprocessor DU8 continues processing. Otherwise, microprocessor DU8 ignores the received signal.

Microprocessor DU8 deciphers signal RXD to determine the operation requested by the fob. However, prior to acting upon the request, microprocessor DU8 may sequentially enable the LOWBAT1 and LOWBAT2 signals to insure that the batteries have sufficient power for completing the requested operation and otherwise detect low battery conditions. If the batteries have sufficient power, the motor of the actuator may be enabled by microprocessor DU8 by activating the MOTOR+ and MOTOR− inputs in accordance with switch DSW5. While the motor is in operation, the current in the motor may be sensed by motor sensing circuit 854 and common sense circuit 856.

Microprocessor DU8 may monitor the completion of the requested operation through switches DSW1, DSW3 and DSW4. Upon completion of the request, LED DD4 may be set in accordance with a predetermined scheme, for example, LED DD4 may flash twice to indicate successful completion. The status of the actuator may then be transmitted via signal TXD and transmitter 860.

After transmitting a signal, fob unit microprocessor FU2 enables its receiver in anticipation of receiving status from the door unit. The receiver is enabled by activating transistor FQ2A, which activates transistor FQ2B to supply signal VREC to power the receiver. Microprocessor FU2 may enable receiver 836 for a predetermined amount of time after transmitting a request and then disable receiver 836 after receiving a response or after the predetermined amount of time, if no response is received. Receiver 836 receives the signal and supplies it to microprocessor FU2 via signal RX. Signal RX is deciphered by microprocessor FU2, which in turn may generate, for example, an audible alarm via a buzzer.

Figure 21:
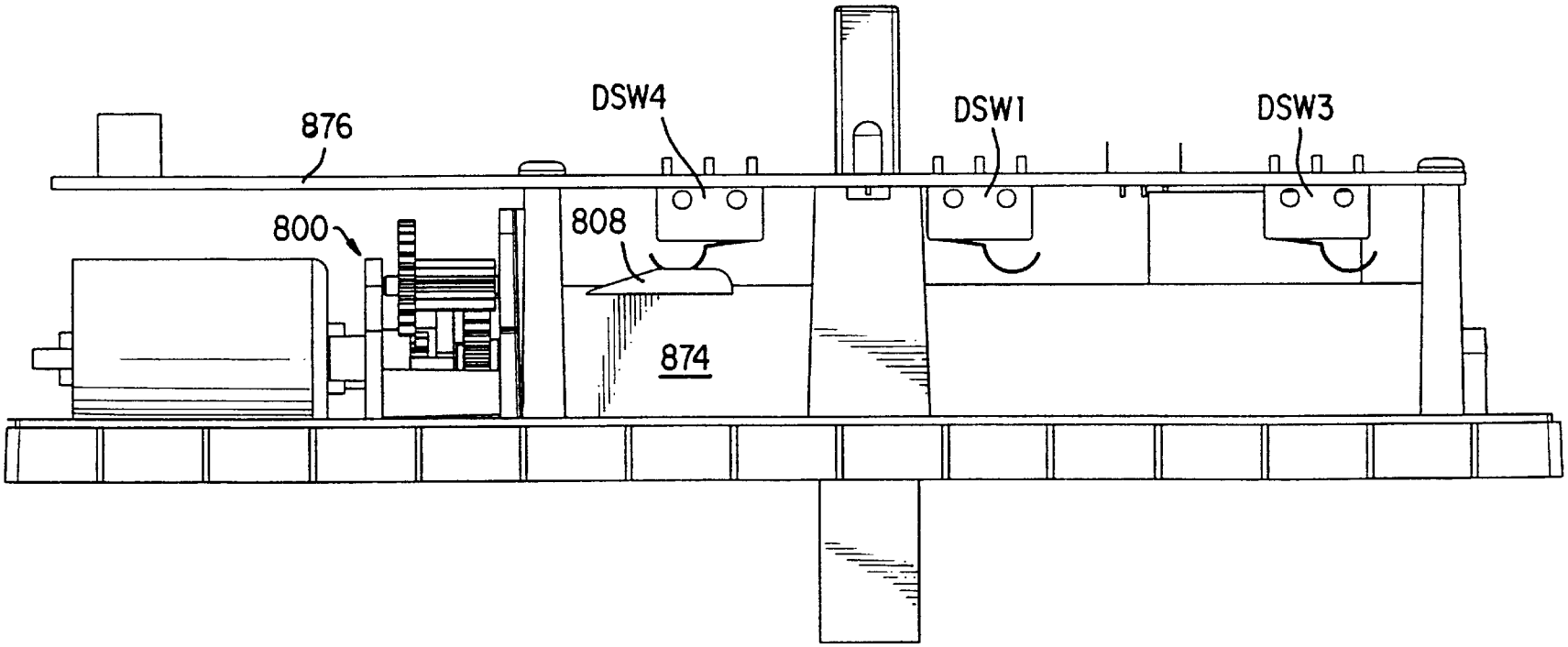
FIG. 21 is a side view of the actuator shown in FIG. 13.

A mechanical arrangement for switches DSW1, DSW3 and DSW4 with respect to actuator 800 is shown in FIG. 21, which is a side view. A portion of actuating arm 808 rests on a guide 874. Switches DSW1, DSW3 and DSW4 are mounted on a printed circuit board 876, which preferably has the door unit circuitry mounted thereon and is mounted above guide 874. Switch DSW1 is positioned such that contact is made between a portion of actuating arm 808 and switch DSW1 when actuating arm 808 is in the neutral position. DSW3 is positioned such that contact is made between a portion of actuating arm 808 and switch DSW3 when actuating arm 808 is in the lock position. Similarly, switch DSW4 is positioned such that contact is made between a portion of actuating arm 808 and switch DSW4 when actuating arm 808 is in the unlock position. Contact between actuating arm 808 and switch DSW4 is shown in FIG. 21.

Figure 10:
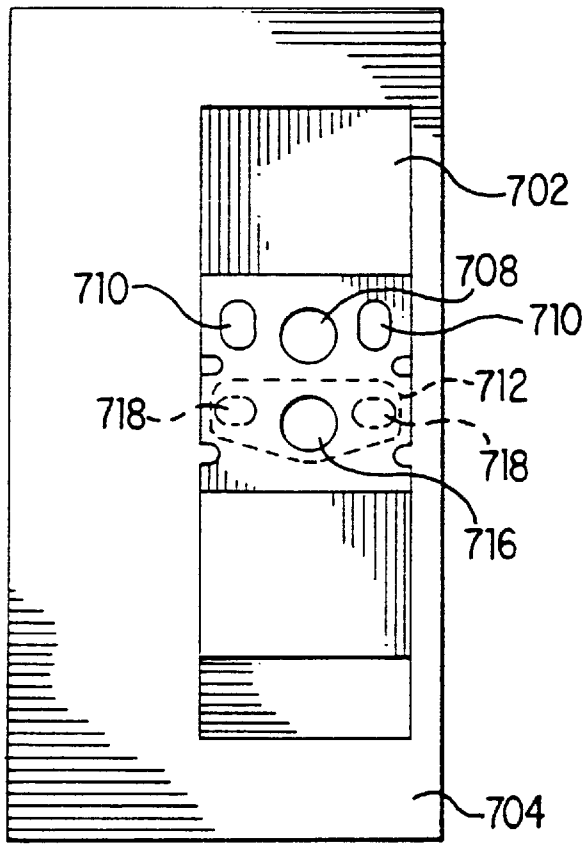
FIG. 10 is a front plan view of the plate of FIG. 9 with the mounting portion in a second position.
Figure 9:
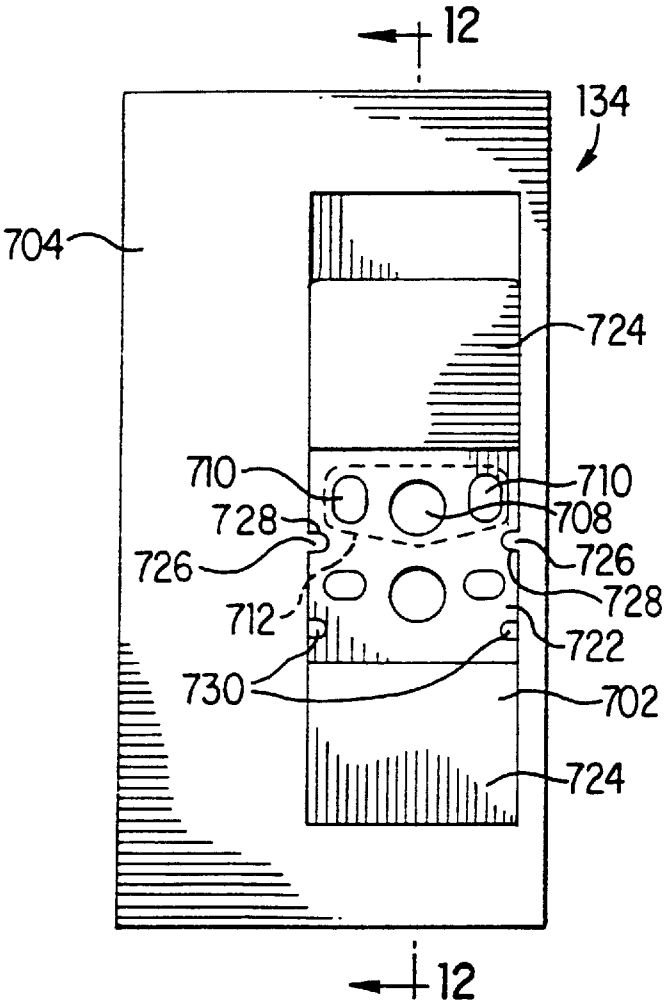
FIG. 9 is a front plan view of a plate having a mounting portion in a first position for retrofitting an existing dead-bolt assembly with an actuator in accordance with the present invention.

The actuator assemblies described above and shown in FIGS. 1–6 may be readily retrofit on an existing lock or dead-bolt assembly. To facilitate retrofitting an existing lock or dead-bolt assembly, a plate 134 including a mounting portion 702 and a support portion 704 is provided as shown in FIGS. 9–12. In FIG. 9, mounting portion 702 is shown in a first position wherein a first set of holes, including center hole 708 and perimeter holes 710 are aligned with an opening 712 in support portion 704. In FIG. 10, mounting portion 702 is shown in a second position wherein a second set of holes, including center hole 716 and perimeter holes 718 are aligned with opening 712.

Center holes 708, 716 are for receiving the drive bar and perimeter holes 710, 718 are for receiving the bolts that hold the lock to the door. In the preferred embodiment, the first and second set of holes are sized and spaced to accommodate a number of different locks from a variety of lock manufacturers. For example, mounting portion 702 shown in FIGS. 9–10 has circular center holes 710, 718 spaced 1.875 inches apart from center to center having diameters of 1.2 inches. Perimeter holes 710, 718 are generally oval in shape with holes 710 being rotated approximately ninety degrees from holes 718.

Figure 12:
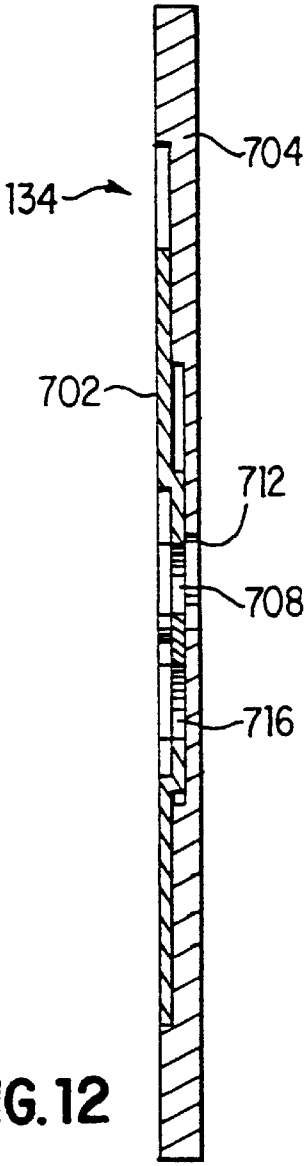
FIG. 12 is a cross-sectional view of the plate shown in FIG. 9 taken along line 12—12.
Figure 11:
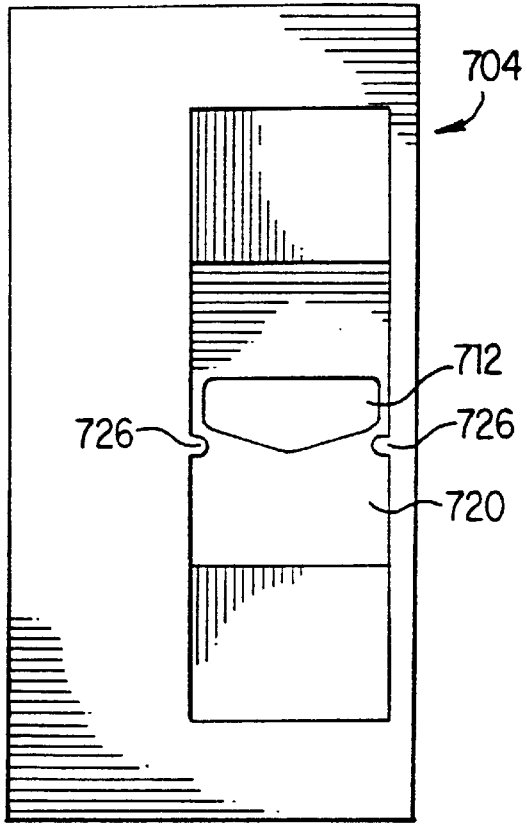
FIG. 11 is a front plan view of the plate of FIG. 9 with the mounting portion removed.

As shown in FIGS. 11 and 12, support portion 704 has a recess portion 720 for receiving mounting portion 702. Similarly, mounting portion 702 has a recessed portion 722 and flanged end portions 724. Formed within recessed portion 720 are protrusions 726. A first pair of notches 728 and a second pair of notches 730 are provided in mounting portion 702 for alternatively mating with protrusions 726 to align mounting portion 702 in the first and second positions shown in FIGS. 9 and 10, respectively.

To retrofit an existing lock using plate 134, first, the interior cylinder or knob is removed. Then, support portion 704, preferably including a preassembled actuator assembly, such as assembly 12, assembly 112, assembly 212, or assembly 312 is positioned over the exterior cylinder and existing mounting hardware. For example, for assembly 312 shown in FIGS. 4, 4A and 4B, the preassembled actuator assembly may include motor 320, threaded rod 322, actuating arm 324 and any appropriate circuitry, including any sensors desired, prearranged and assembled onto plate 134. Next mounting portion 702 is positioned over the existing mounting hardware by alignment in either the first or second position. Then, a rotating device, such as adaptor 26 and lever 28, lever 128, lever 238, lever 328 or adaptor 329, is secured onto the drive bar. Finally, a protective cover may be provided over plate 134 and the interior cylinder or knob may be retrofit onto the extended drive bar, completing the retrofit of an actuator assembly onto an existing lock or dead-bolt assembly.

Figure 22:
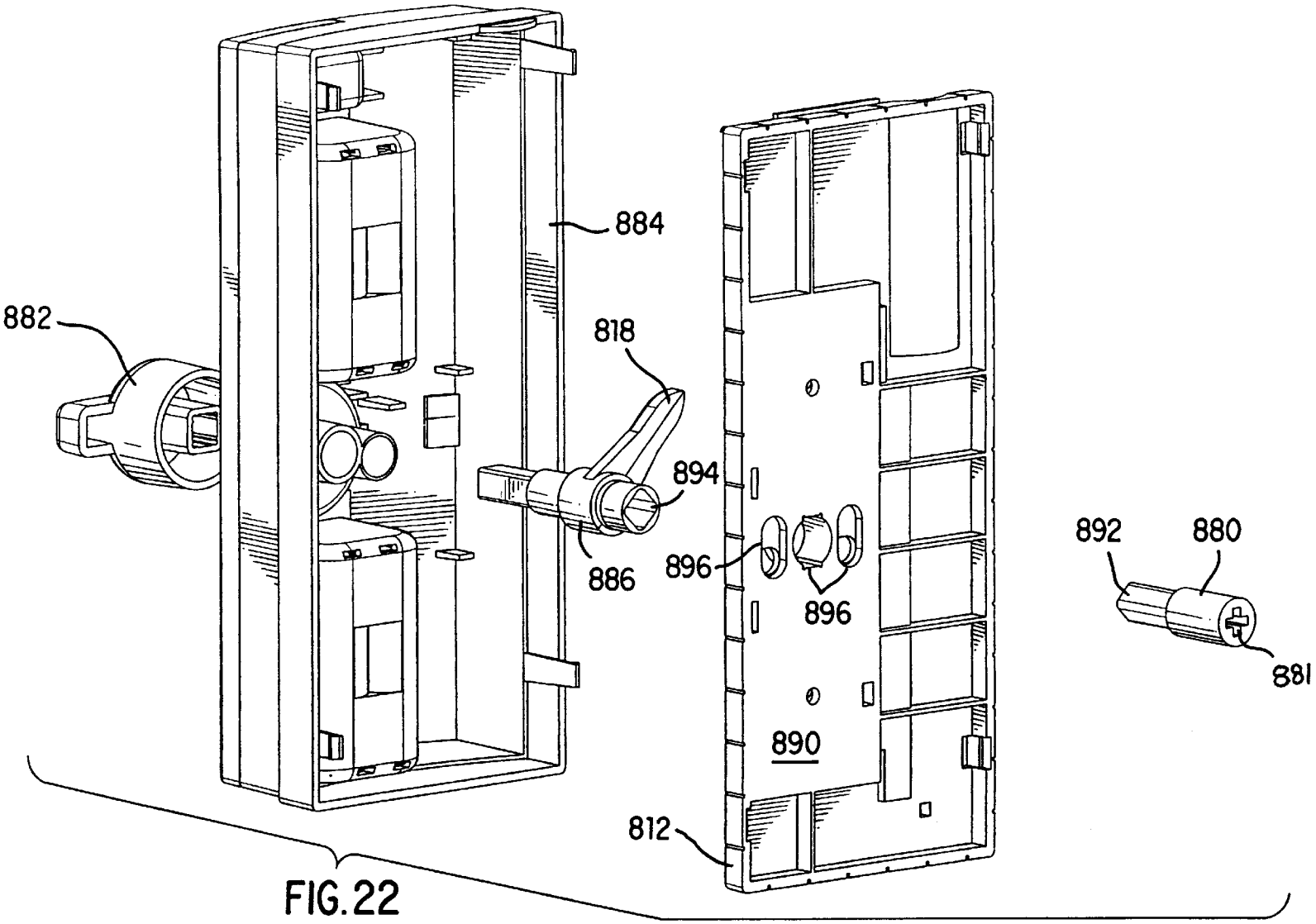
FIG. 22 is an exploded perspective view of the actuator shown in FIG. 13 with a cover, knob and adaptor.
Figure 23:
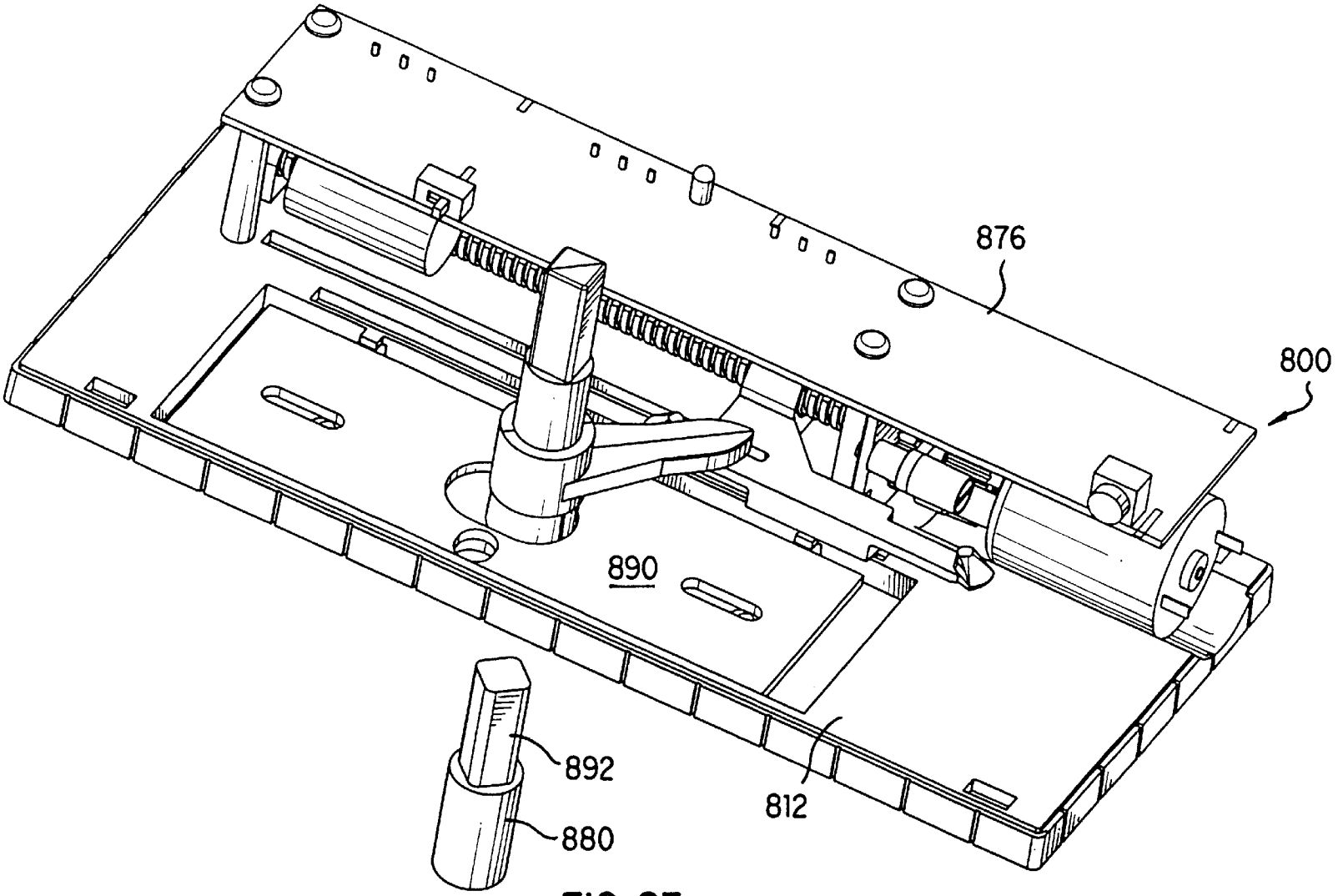
FIG. 23 is an exploded perspective view of the actuator shown in FIG. 13 with an adaptor.

An alternate and preferred method for retrofitting the actuator assemblies described above, and in particular, actuator 800 shown in FIG. 13 is described below with respect to FIGS. 22 and 23, which show exploded views of actuator 800 and an adaptor 880. FIG. 22 shows a knob 882, a cover 884, a lever assembly 886, base plate 812 and adaptor 880. FIG. 23 shows adaptor 880 and base plate 812. Mounted on base plate 812 is actuator 800 and a printed circuit board 876 with the door unit circuitry mounted thereon. Slidably disposed within a recessed portion of base plate 812 is a mounting plate 890. Cover 884 encases and covers a surface of base plate 812, actuator 800, and printed circuit board 876.

To retrofit an existing lock, a preassembled actuator assembly is provided, including an attached combination of knob 882, cover 884, lever assembly 886, and base plate 812. Knob 882 could be a cylinder rather than a knob. Adaptor 880 includes an aperture 881 sized and configured to fit a drive bar. Aperture 881 may be varied in size and configuration to fit drive bars from different lock manufacturers. The interior cylinder or knob is removed from the existing dead bolt or lock assembly. Then the appropriate adaptor, i.e., one that fits the drive bar, is placed over the drive bar of the existing lock. The preassembled actuator is aligned over the adaptor such that the drive bar extension 892 fits in a bore 894 of lever assembly 886. Drive bar extension 892 and bore 894 are both rectangular in configuration so that drive bar extension 892 may snugly fit within bore 894 such that rotation of lever assembly 886 causes rotation of adaptor 880. Mounting plate 890 is aligned so that screws or bolts may be replaced in holes 896. Then the preassembled actuator is secured in place. As an alternative, the adaptor may be placed in the preassembled actuator prior to placing the adaptor and preassembled actuator over the drive bar of the existing lock. This method of retrofitting to an existing lock advantageously allows the actuator to remain concealed within its housing during installation.

Described above is an electrically operated actuator that is capable of automating locking and unlocking of door locks and dead-bolt assemblies, while preserving the conventional manual operation of such locks and assemblies. Additionally, the electrically operated actuator is readily retrofit on an existing lock or dead-bolt assembly.

While the present invention has been described with respect to certain preferred embodiments and modifications thereof, it will be appreciated by those skilled in the art that certain other modifications are possible and fall within the scope of the invention as expressed in the accompanying claims.

What is claimed is:

1. An electrically operated actuator for operating a lock, the lock having a bolt operably coupled to a drive bar, the actuator comprising:

a lever attached to the drive bar, said lever having an axis of rotation that is coaxial with an axis of rotation of the drive bar, said lever being pivotal from a first position wherein the bolt is retracted to a second position wherein the bolt is extended;

a motor capable of rotating a threaded rod operably attached thereto in a clockwise and counterclockwise direction;

an actuating arm screwed onto said threaded rod having a first protrusion on one end of said arm and a second protrusion on an opposite end of said arm; said arm having means to prevent rotation of said arm about said threaded rod;

said actuating arm being positioned on said threaded rod with respect to said lever such that said first protrusion is capable of contacting and pivoting said lever to said first position and said second protrusion is capable of contacting and pivoting said lever to said second position; and fail-safe means for allowing said lever to attain said first position by forcing said first protrusion out of the path of said lever and for allowing said lever to attain said second position by forcing said second protrusion out of the path of said lever.

2. The actuator of claim 1 wherein said lever is resilient.

3. The actuator of claim 1 wherein said first and second protrusions are flexible.

4. The actuator of claim 1 wherein said first and second protrusions are cantilevered.

5. The actuator of claim 1 wherein said first and second protrusions are angled.

6. An electrically operated actuator in combination with a dead bolt assembly, the dead bolt assembly comprising a lock having a drive bar and a bolt, the bolt being operably coupled to the drive bar such that rotation of the drive bar extends and retracts the bolt linearly, the actuator comprising:

means for rotating the drive bar to extend and retract the bolt;

means for driving said rotating means, said driving means being responsive to an electrical signal;

wherein said electrical signal is generated by a circuit comprising:

a wireless transmitter that transmits a request to actuate the actuator;

a wireless receiver that receives the request to actuate the actuator;

a control circuit, operably connected to said wireless receiver, the control circuit providing said electrical signal to said driving means if the request is valid; and a plurality of sensors positioned around the driving means for sensing the status of the lock.

7. The actuator of claim 6 wherein said plurality of sensors are switches that detect a plurality of positions of said driving means.

8. The actuator of claim 7 wherein said switches are positioned on a circuit board mounted above said driving means, said switches being positioned to contact said driving means when said driving means is in a plurality of predetermined positions.

9. The actuator of claim 6 wherein said receiver comprises:

a preamplifier that receives a signal and amplifies said signal to produce a preamplified signal;

a super-regenerative, self-quenching oscillator coupled to said preamplifier for sensing said preamplified signal and producing a remaining signal;

a gain and filtering stage coupled to said super-regenerative, self-quenching oscillator to receive said remaining signal and produce an amplified signal; and a data slicer coupled to said gain and filtering stage to receive said amplified signal and produce a received signal with logic levels.

10. The actuator of claim 6 wherein said transmitter transmits a pulse-width modulated signal.

11. An electrically operated actuator for operating a lock, the lock having a bolt operably coupled to a drive bar, the actuator comprising:

means for rotating the drive bar to extend and retract the bolt;

means for driving said rotating means, said driving means being responsive to an electrical signal;

wherein said electrical signal is generated by a circuit comprising:

a transmitter for transmitting a request to actuate the actuator;

a receiver for receiving the request to actuate the actuator;

a control circuit, operably connected to said receiver, that generates said electrical signal to said driving means if the request is valid;

a plurality of sensors positioned around the driving means for sensing the status of the lock;

wherein said receiver comprises:

a preamplifier that receives a signal and amplifies said signal to produce a preamplified signal;

a super-regenerative, self-quenching oscillator coupled to said preamplifier for sensing said preamplified signal and producing a remaining signal;

a gain and filtering stage coupled to said super-regenerative, self-quenching oscillator to receive said remaining signal and produce an amplified signal; and a data slicer coupled to said gain and filtering stage to receive said amplified signal and produce a received signal with logic levels.

12. An electrically operated actuator in combination with a dead bolt assembly, the dead bolt assembly comprising a lock having a drive bar and a bolt, the bolt being operably coupled to the drive bar such that rotation of the drive bar extends and retracts the bolt linearly, the actuator comprising:

a drive bar attachment that is coupled to the drive bar to extend and retract the bolt linearly;

a motor being responsive to an electrical signal;

a gear assembly operably coupled to the motor to respond to rotation of said motor, the gear assembly being coupled to said drive bar attachment to engage said drive bar attachment to extend or retract the bolt linearly;

wherein said electrical signal is generated by a circuit comprising:

a wireless transmitter that transmits a request to actuate the actuator;

a wireless receiver that receives the request to actuate the actuator;

a control circuit operably connected to said receiver, the control circuit providing said electrical signal to said motor if the request is valid.

13. The actuator of claim 12 wherein the gear assembly includes a gear with at least one protrusion and said at least one protrusion is adapted to engage said drive bar attachment to extend and retract the bolt linearly.

14. The actuator of claim 13 wherein said at least one protrusion is adapted to frictionally engage said drive bar attachment to extend and retract the bolt linearly.

15. The actuator of claim 13 wherein the gear has teeth on an arcuate perimeter and the protrusion extends outwardly from a surface of the gear, the surface being orthogonal to the arcuate perimeter of the gear.

16. The actuator of claim 12 wherein said drive bar attachment is a lever that is coupled to the drive bar.

17. The actuator of claim 13 wherein the at least one protrusion is also adapted to disengage with said drive bar attachment in response to rotation of said drive bar attachment for fail safe operation.

18. The actuator of claim 17 wherein the at least one protrusion is also adapted to flexibly disengage with said drive bar attachment.

19. The actuator of claim 13 wherein the at least one protrusion is adapted to disengage with said drive bar attachment in response to rotation of the gear assembly to place the drive bar attachment in a state whereby the bolt may be extended or retracted manually.

* * * * *